US011541622B2

(12) United States Patent
Valterio et al.

(10) Patent No.: US 11,541,622 B2
(45) Date of Patent: Jan. 3, 2023

(54) CREASING MACHINE, CREASING CYLINDER FOR THE CREASING MACHINE AND METHOD FOR CREASING SHEETS

(71) Applicant: BOBST MEX SA, Mex (CH)

(72) Inventors: Roberto Valterio, Ollon (CH); Yannick Roulin, Cossonay-Ville (CH)

(73) Assignee: BOBST MEX SA, Mex (CH)

( * ) Notice: Subject to any disclaimer, the term of this patent is extended or adjusted under 35 U.S.C. 154(b) by 153 days.

(21) Appl. No.: 16/627,593

(22) PCT Filed: Jun. 25, 2018

(86) PCT No.: PCT/EP2018/025171
§ 371 (c)(1),
(2) Date: Dec. 30, 2019

(87) PCT Pub. No.: WO2019/007552
PCT Pub. Date: Jan. 10, 2019

(65) Prior Publication Data

US 2020/0130318 A1 Apr. 30, 2020

(30) Foreign Application Priority Data

Jul. 6, 2017 (DE) ..... 102017115164.8

(51) Int. Cl.
*B31F 1/10* (2006.01)
*B31F 1/08* (2006.01)
(Continued)

(52) U.S. Cl.
CPC ..... *B31F 1/10* (2013.01); *B31F 1/08* (2013.01); *B31B 50/252* (2017.08); *B31B 50/256* (2017.08); *B31B 50/56* (2017.08)

(58) Field of Classification Search
CPC ..... B31F 1/10; B31F 1/08; B31F 1/07; B31F 1/14; B31F 1/145; B31F 1/26;
(Continued)

(56) References Cited

U.S. PATENT DOCUMENTS 1,499,985 A * 7/1924 Kirsch ..... B21D 53/00 428/595
2,954,068 A * 9/1960 Williamson ..... B21D 24/02 100/269.06
(Continued)

FOREIGN PATENT DOCUMENTS

CN 1633358 A 6/2005
CN 102666083 A 9/2012
(Continued)

OTHER PUBLICATIONS

International Search Report (3 pages) issued in related PCT/EP2018/025171 dated Oct. 12, 2018.

*Primary Examiner* — Gloria R Weeks
*Assistant Examiner* — Mobeen Ahmed
(74) *Attorney, Agent, or Firm* — Bookoff McAndrews, PLLC

(57) ABSTRACT

A creasing machine includes a creasing tool, a counter element cooperating with the creasing tool, and a transportation system for advancing sheets through a creasing area between the creasing tool and the counter element, wherein the creasing tool has a creasing plate provided with at least one creasing projection, and wherein the creasing projection on the creasing plate is constituted by a plurality of small, plastically deformed areas which merge into each other so as to form the creasing projection.

25 Claims, 19 Drawing Sheets

Figure 1:
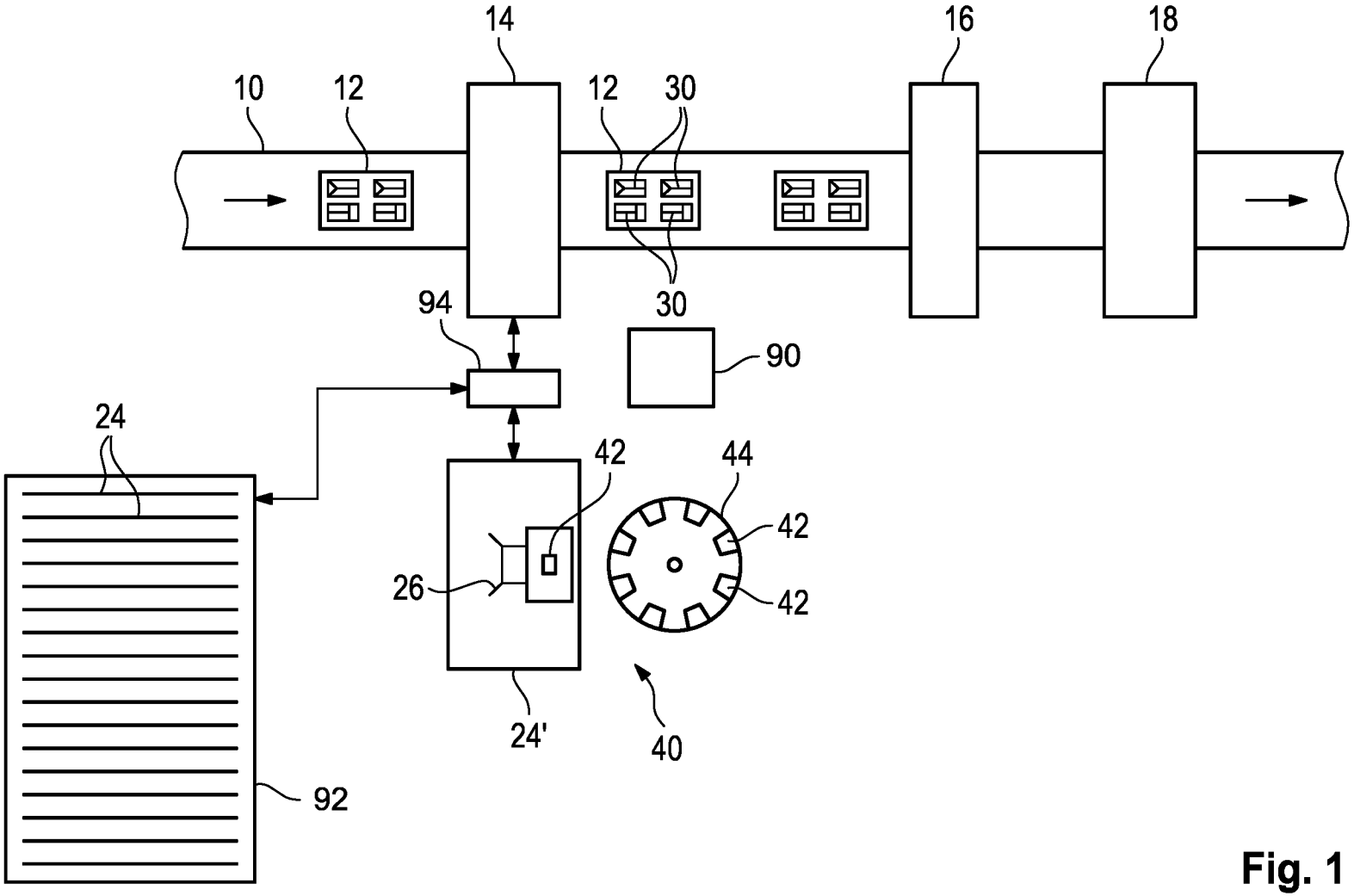

(51) Int. Cl.
*B31B 50/25* (2017.01)
*B31B 50/56* (2017.01)

(58) Field of Classification Search
CPC ..... B31F 2201/07; B31F 2201/0702; B31F 2201/0715; B31F 2201/0717; B31F 2201/0723; B31F 2201/073; B31F 2201/0733; B31B 50/256; B31B 50/252; B31B 50/54; B31B 50/56; B23Q 23/00; B23Q 41/08
See application file for complete search history.

(56) References Cited

U.S. PATENT DOCUMENTS 3,076,367 A * 2/1963 Leibinger ..... B21D 43/04 83/412
3,225,636 A * 12/1965 Schott ..... B21D 28/265 269/291
3,643,483 A * 2/1972 Minchenko ..... B21D 22/04 72/347
3,884,132 A 5/1975 Snodgrass
4,116,594 A * 9/1978 Leanna ..... F16C 13/00 425/3
4,224,851 A * 9/1980 Imai ..... B26D 7/1818 83/123
4,249,243 A * 2/1981 Yoshida ..... B23Q 3/15539 318/569
4,289,492 A * 9/1981 Simpson ..... B31F 1/10 493/396
4,299,643 A * 11/1981 Cross ..... B21D 5/08 248/463
4,348,464 A * 9/1982 Khoury ..... B21D 11/08 428/572
4,665,607 A * 5/1987 Ressencourt ..... B23K 26/1462 29/33 R
4,719,691 A * 1/1988 Klingel ..... B23Q 3/15566 83/563
4,771,663 A * 9/1988 Naito ..... B23D 27/00 83/237
4,803,772 A * 2/1989 Leverenz ..... B23Q 3/15573 269/319
4,934,231 A * 6/1990 Chesnut ..... B23K 9/007 83/675
4,937,768 A * 6/1990 Carver ..... G05B 19/41805 700/86
5,224,915 A * 7/1993 Kilian ..... B21D 28/12 83/563
5,281,511 A * 1/1994 Gerhardt ..... B44B 5/026 430/323
5,284,043 A * 2/1994 Hayashi ..... B21D 28/12 225/2
5,488,889 A * 2/1996 Kang ..... B26F 1/44 83/346
5,505,125 A * 4/1996 Kapolnek ..... B29C 59/002 101/22
5,555,759 A * 9/1996 Rosene ..... B21D 17/04 72/182
5,575,168 A * 11/1996 Rosene ..... B21D 28/12 72/182
5,595,560 A * 1/1997 Kamada ..... B21D 37/145 83/559
5,761,944 A * 6/1998 Endo ..... B21D 17/04 72/133
5,969,973 A * 10/1999 Bourne ..... G05B 19/4097 700/165
5,970,836 A * 10/1999 Sorel ..... B26F 1/02 83/559
6,010,440 A * 1/2000 Miyano ..... B23Q 39/042 483/1
6,131,430 A * 10/2000 Schneider ..... B21D 17/04 72/75
6,162,155 A * 12/2000 Gordon ..... B31B 50/00 493/402
6,163,734 A * 12/2000 Shigefuji ..... G05B 19/19 83/13
6,368,263 B1 * 4/2002 Lynch ..... B26D 5/00 493/34
6,644,153 B1 * 11/2003 Gordon ..... B26D 7/1818 83/139
6,682,468 B2 * 1/2004 Lauderbaugh ..... E06B 3/28 493/396
6,716,017 B2 * 4/2004 Papadopoulas ..... B31F 1/07 492/38
6,796,156 B2 * 9/2004 Natalis ..... B44B 3/061 29/90.01
7,490,710 B1 * 2/2009 Weskamp ..... B23Q 7/1426 29/33 P
7,563,220 B2 * 7/2009 Harris ..... B31F 1/10 493/401
7,565,856 B2 * 7/2009 Pfaff, Jr. ..... B26D 7/2628 83/698.42
8,155,770 B2 * 4/2012 Barlovic ..... G05B 19/41865 700/192
8,459,086 B2 * 6/2013 Vigurs ..... B21C 37/0815 72/367.1
9,045,292 B1 * 6/2015 Ben-David ..... B65H 31/24 700/223
11,059,253 B2 * 7/2021 Zimmer ..... B23K 26/0892
2003/0045948 A1 * 3/2003 Hwang ..... G05B 19/40938 700/56
2004/0118304 A1 * 6/2004 Corcoran ..... B31F 1/07 101/28
2004/0214703 A1 * 10/2004 Berens ..... B26D 7/20 493/51
2005/0061049 A1 * 3/2005 Durney ..... B21D 11/08 72/324
2005/0209076 A1 9/2005 Boutron et al.
2005/0257594 A1 * 11/2005 Hutchison ..... B26D 7/2628 72/482.93
2005/0263020 A1 * 12/2005 Schoellhorn ..... B41F 27/105 101/383
2007/0000365 A1 * 1/2007 Hirahara ..... B26D 5/02 83/76.1
2007/0101798 A1 * 5/2007 Sakamoto ..... B21D 22/08 72/442
2007/0163413 A1 * 7/2007 Salusbury ..... B31B 50/16 83/697
2009/0136679 A1 * 5/2009 Boukaftane ..... B05D 1/002 118/620
2010/0006216 A1 * 1/2010 Lombardo ..... B26D 7/2614 156/510
2010/0018277 A1 * 1/2010 Hielscher ..... C21D 8/0252 72/352
2010/0319433 A1 12/2010 Vigors
2011/0036135 A1 * 2/2011 Hill ..... B23D 25/08 72/190
2011/0294913 A1 * 12/2011 Zimmer ..... C08L 23/02 524/590
2012/0121802 A1 * 5/2012 Zimmer ..... C08L 23/02 118/697
2012/0266725 A1 * 10/2012 Knausdorf ..... B26F 1/44 76/4
2013/0292226 A1 * 11/2013 Ben-David ..... B26D 7/1854 198/688.1
2014/0033938 A1 * 2/2014 Whitelaw ..... B41F 9/04 101/171
2014/0206514 A1 * 7/2014 Lootvoet ..... B31B 50/146 493/52
2014/0357463 A1 12/2014 Kojima
2014/0374500 A1 * 12/2014 Spiryagin ..... B05C 5/02 239/302
2015/0101388 A1 * 4/2015 Higai ..... B21C 37/0815 72/356
2015/0158263 A1 * 6/2015 Maddala ..... B31F 1/07 118/44
2015/0165504 A1 * 6/2015 Fukunaga ..... B21D 28/12 72/379.2

(56) References Cited

U.S. PATENT DOCUMENTS

| | | | | |
|---|---|---|---|---|
| 2015/0231739 | A1* | 8/2015 | Zimmer | B23K 26/60 219/121.68 |
| 2016/0008998 | A1* | 1/2016 | Dénisse | B31F 1/07 83/887 |
| 2016/0016324 | A1* | 1/2016 | Bapst | B26F 1/384 29/401.1 |
| 2016/0121384 | A1* | 5/2016 | Sumikawa | B21D 22/26 72/352 |
| 2016/0130025 | A1* | 5/2016 | Azad | G06Q 10/04 493/1 |
| 2017/0313018 | A1* | 11/2017 | Pessotto | B31F 1/07 |
| 2018/0154602 | A1* | 6/2018 | Block | B31B 50/8126 |
| 2018/0178479 | A1* | 6/2018 | Kellermann | B26F 1/44 |
| 2018/0244011 | A1* | 8/2018 | Lim | B23D 33/006 |
| 2019/0018628 | A1* | 1/2019 | Sloan, IV | B26D 7/27 |
| 2019/0030582 | A1* | 1/2019 | Olsson | G06Q 10/043 |
| 2019/0134934 | A1* | 5/2019 | Or | B31B 50/14 |
| 2019/0152185 | A1* | 5/2019 | Fustinoni | B31B 50/256 |
| 2019/0168276 | A1* | 6/2019 | Otsuka | B21D 19/00 |
| 2020/0122213 | A1* | 4/2020 | Valterio | B31F 1/08 |
| 2020/0130318 | A1* | 4/2020 | Valterio | B31F 1/10 |
| 2020/0215782 | A1* | 7/2020 | Valterio | B31B 50/252 |
| 2021/0078281 | A1* | 3/2021 | Schweikhardt | B31F 1/07 |
| 2021/0129476 | A1* | 5/2021 | Linnestad | B31B 50/006 |

FOREIGN PATENT DOCUMENTS

| | | | | |
|---|---|---|---|---|
| CN | 203697879 | U | 7/2014 | |
| CN | 104416956 | A | 3/2015 | |
| DE | 549126 | C | 4/1932 | |
| DE | 10062294 | A1 | 6/2002 | |
| DE | 10303178 | A1 | 7/2004 | |
| DE | 102006045346 | A1 | 3/2008 | |
| DE | 102008025221 | A1 | 12/2009 | |
| DE | 102009028003 | A1 | 1/2011 | |
| DE | 202009018439 | U1 | 1/2012 | |
| EP | 1902821 | A1 * | 3/2008 | B26F 1/40 |
| GB | 1060313 | A | 3/1967 | |
| JP | H04216036 | A | 8/1992 | |
| JP | 2000289124 | A | 10/2000 | |
| JP | 2003165166 | A | 6/2003 | |
| JP | 2004148763 | A | 5/2004 | |
| JP | 2005193523 | A | 7/2005 | |
| JP | 2015229322 | A | 12/2015 | |
| WO | 2004024432 | A1 | 3/2004 | |
| WO | 2014045271 | A1 | 3/2014 | |
| WO | 2016074798 | A1 | 5/2016 | |
| WO | 2016169574 | A1 | 10/2016 | |

* cited by examiner

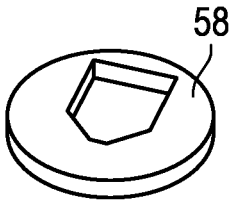
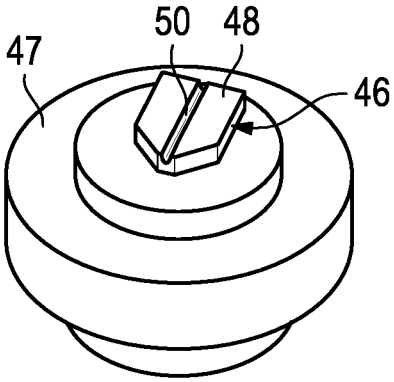
Fig. 7a
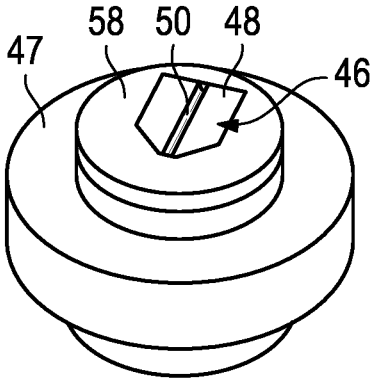
Fig. 7b
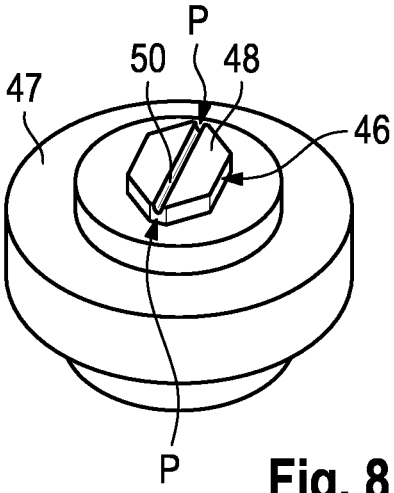
Fig. 8
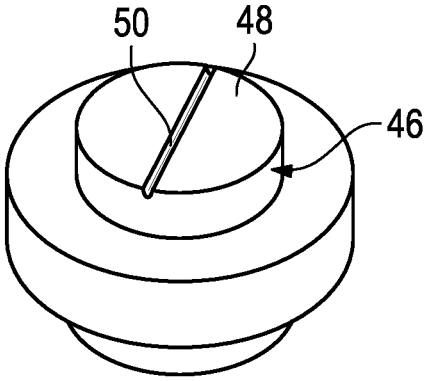
PRIOR ART Fig. 9

CREASING MACHINE, CREASING CYLINDER FOR THE CREASING MACHINE AND METHOD FOR CREASING SHEETS

CROSS-REFERENCE TO RELATED APPLICATION(S)

This application is a National Stage under 35 U.S.C. § 371 of International Application No. PCT/EP2018/025171, filed Jun. 25, 2018, which claims priority to German Patent Application No. 102017115164.8, filed Jul. 6, 2017, the contents of all of which are incorporated by reference in their entirety.

The invention relates to a creasing machine having a creasing tool, a counter element cooperating with the creasing tool, and a transportation system for advancing sheets through a creasing area between the creasing tool and the counter element, the creasing tool having a creasing plate provided with at least one creasing projection. The invention further relates to a creasing plate adapted for being used in the creasing machine and to a method for creasing sheets, in particular made from carton, cardboard or foil.

Creasing machines are used for generating one or more creases in a sheet from which blanks are cut which are folded. Each of the creases forms kind of a "hinge" which allows the later formed blanks to be folded at a well-defined place.

The creasing machine can be formed as a device or system which is either a standalone unit or is integrated into a larger machine or system such as a printing machine or a finishing machine.

The sheets can be made from cardboard, carton or a foil, and they can be provided to the creasing machine separately or in a continuous manner as part of a web.

The creases are formed by locally applying a pressure onto the sheet. To this end, creasing knives are known which are pressed onto the surface of the sheet so as to generate the crease. It is also known to provide local projections on the creasing tool, for example by etching away those portions of the creasing tool which shall not project, or by locally applying a plastic material in a liquid condition, which is then cured.

The creasing tool can either be generally flat and be moved back and forth in a direction which is generally perpendicular with respect to the plane in which the sheet extends, or it can be generally cylindrical and be rotated so as to engage at the sheet when it is being transferred through the creasing area.

The problem with all creasing machines is that they can hardly be quickly adapted to a specific pattern of creases to be applied to a sheet. This has become more of a problem since digital printing allows changing very quickly from one printing job to a different one.

Assuming that the creasing tool is to be manufactured by means of an etching process, it may take several hours until a new creasing tool is available. Assuming that the creasing projections are formed by applying a plastic material to a carrier, the manufacturing times might be shorter, depending on the time which is necessary for curing the plastic material. However, the lifetime of such a creasing tool is significantly shorter than the lifetime of a creasing tool comprising an etched steel plate. In any case, the step of adapting the creasing machine to a new creasing job is the bottleneck when the creasing machine is used in connection with a digital printing machine.

The object of the invention is to provide a creasing tool and a creasing method which can be quickly changed from one creasing pattern to another creasing pattern.

In order to achieve this object, the invention provides a creasing machine as defined above, which is characterized in that the creasing projection on the creasing plate is constituted by a plurality of small, plastically deformed areas which merge into each other so as to form the creasing projection. Further, the invention provides a creasing plate adapted for being used in a creasing machine of this type, the creasing plate being formed from sheet metal and comprising at least one creasing projection formed from a plurality of small, plastically deformed areas which merge into each other so as to form the creasing projection. Finally, the above object is solved by a method for creasing sheets, in particular made from paper, cardboard or foil, in which data regarding folding creases to be applied to the sheet is provided, and a control determines if a suitable creasing plate is available in an inventory or if a new creasing plate is to be manufactured. Based on the determination of the control, either an existing creasing plate is retrieved from the inventory or a new creasing plate is manufactured by using a punching machine for applying a plurality of small deformations to a creasing plate sheet, the deformations constituting at least one creasing projection. Finally, the creasing plate is mounted on a creasing tool, and the creasing tool cooperates with a counter element for applying folding creases to sheets advanced through a creasing area between the creasing tool and the counter element.

The invention is based on the concept of using a metal creasing plate in which the creasing projection is formed by a large number of punching strokes, the individual punching strokes generating the creasing projection. This allows achieving two advantages. First, the creasing plate has a long lifetime as there is very little wear at the creasing projections, simply because they are made from metal. The strain hardening which inevitably occurs during punching contributes to the wear resistance of the creasing plate. Second, individual creasing plates can be manufactured quickly and with very little effort by for example a turret punching machine or a coil punching machine.

According to a preferred embodiment, a punching module is provided at the creasing machine. It is thus not necessary to install a separate punching machine. Rather, a dedicated (smaller) punching module can be integrated into the machine so as to form a self-contained creasing machine which does not require any external machinery when it comes to manufacturing the creasing plates.

The punching module is preferably a turret punching machine or a coil punching machine as these types of machine allow manufacturing the creasing plates in a very flexible yet quick manner.

Preferably, the punching module has a punch and a die, the punch having rounded end portions. The rounded end portions help in ensuring a smooth transition between the individually deformed areas so as to create a continuous creasing projection.

Depending on the geometry of the creasing projection, the rounded end portions have at least one of a large and a small radius. A large radius is advantageous for achieving a smooth transition between the separately deformed areas which form the creasing projection. A small radius is advantageous for creating a creasing projection which either terminates in a very small distance from an adjacent creasing projection, or which even intersects with the adjacent creasing projection.

According to an embodiment, the punch extends along a straight line and has a length, measured along the straight line, in the order of 5 to 50 mm. The longer the punch, the less individual strokes are necessary for generating a creasing projection. However, shorter punches increase the flexibility and decrease the force which is necessary for deforming the creasing plate.

According to a preferred embodiment, the die has a recess for receiving material plastically deformed by the punch, the recess having at least one laterally open end, the open end coinciding with one of the rounded end portions of the punch. This geometry of the die helps in generating creasing projections which either terminate in a very small distance from each other or even merge into each other as an already generated creasing projection can be positioned immediately adjacent the open end of the die so that the punch can very precisely deform the material of the creasing plate at a point very close to the already existing creasing projection.

The die preferably has an outer contour which extends, adjacent the open end of the recess, at an angle of less than 90° with respect to the longitudinal direction of the recess, more preferably at an angle of 45° with respect to the longitudinal direction of the recess. The advantage of this geometry is that merging creasing projections can be generated which extend at an angle of 45° with respect to each other.

According to a preferred embodiment of the invention, an elastic ejector is associated with the die. The ejector helps pushing the plastically deformed material out of the die. Further, it prevents that the creasing plate be scratched by touching the die.

The elastic ejector can have the form of a plate made from rubber or an elastomer. Such plate can be cut in a very precise manner by waterjet cutting.

Preferably, the ejector surrounds the die. This allows mounting the elastic ejector to the die by simply forming the elastic ejector with a suitable inner contour adapted to the outer contour of the die.

According to a preferred embodiment, a handling system is provided for transferring manufactured creasing plates from the punching module to the creasing tool. Such handling system is beneficial in that it allows an automated exchange of one creasing plate against a new creasing plate.

Preferably, the handling system has access to an inventory in which "old" creasing plates are stored. It is thus not necessary to manufacture a new creasing plate each time a different blank is to be generated (in other words: for each new job). Rather, there is a fair chance that a suitable creasing plate can be found in the inventory.

The creasing plate can have a thickness in the range of 0.2 to 0.6 mm. Sheet metal with this thickness on the one hand has a sufficient strength for achieving a long lifetime while it on the other hand does not require excessive punching forces.

Preferably, the creasing plate is made from carbon steel or stainless steel. This material is advantageous as regards its mechanical strength and also in that no problems with corrosion can occur.

The creasing projection can have a height in the order of 0.6 to 1.6 mm. More preferably, a value of approx. 1.2 mm can be used, even though this depends from the material to be creased. The value of 1.2 mm has proven to achieve good results for carton.

At its apex, the creasing projection can have a radius of 0.2 to 0.8 mm, more preferably in the order of 0.35 to 0.55 mm. These values have shown to be a good compromise between sharp, well defined creases on the one hand and a low risk of breaking or otherwise damaging the material of the creasing plate during the manufacturing process on the other hand.

Preferably, the creasing projection has, in a cross section, a width at its base in the order of 1 to 3 mm, preferable approximately 2 mm. The width has an important influence on the crease and is preferably chosen to be smaller for thinner material while a larger width is used for creasing thicker material such as corrugated cardboard.

According to one embodiment of the invention, the creasing tool is a reciprocating plunger to which the creasing plate is mounted. Then, the counter element preferably is a support plate. A reciprocating plunger or piston allows generating the folding creases at one sheet at the same time.

According to a different embodiment of the invention, the creasing tool is a creasing cylinder to which the creasing plate is mounted. Then, the counter element preferably is a counter cylinder. A creasing cylinder rotates with a circumferential speed which corresponds to the speed with which the sheets are advanced through the creasing area. Accordingly, the creasing plate "rolls" over the surface of the sheets which can be continuously advanced.

According to a preferred embodiment of the invention, the cylinders can be adjusted with respect to the plane in which the sheet is transported. This allows changing the creasing direction (from above the sheets to from below the sheets, and vice versa) so as to be able to crease carton and corrugated cardboard on one and the same machine. It is sufficient to exchange which of the cylinders is provided with the creasing plate and which is provided with the layer acting as counter element to the creasing plate, and to change the distance between the axis of rotation of the two cylinders and the plane in which the sheets are being transported through the creasing area between the cylinders.

Preferably, a servo motor is associated to each of the creasing cylinder and the counter cylinder. Using separate drives allows to easily accommodate different speeds of rotation of the cylinders, necessary as a result of the function of the creasing cylinder and the counter cylinder being exchangeable.

For detecting the position of the sheets advanced through the creasing area, a sensor is used. The sensor can detect the forward ends of the arriving sheets, or can detect marks on the sheets. When a creasing cylinder is used as the creasing tool, the creasing plate can either be a curved plate which is clamped to the creasing cylinder, or the creasing plate can be a creasing sleeve which is clamped onto the creasing cylinder. Clamping a creasing plate to the creasing cylinder requires a little more effort than clamping a creasing sleeve onto the creasing cylinder. However, manufacturing a creasing plate involves less effort than manufacturing a creasing sleeve.

Preferably, identical clamping mechanisms are provided on both cylinders. This makes it very easy to change the cylinders from a creasing cylinder to a counter cylinder, and vice versa.

In order to ensure that the creasing plate and the elastic layer are evenly clamped to the cylinders without there being the risk of air pockets being trapped between the outer surface of the cylinders and the sleeves clamped to the cylinders, the clamping mechanism comprises clamping pins extending into openings of the creasing plate. This allows clamping the creasing plate in a very uniform manner.

Preferably, a cam mechanism is provided for moving the clamping pins between a clamping position and a release position. The cam mechanism is technically very reliable and can be rotated by hand using a simple tool, thus avoiding a complicated mechanism.

According to a preferred embodiment of the invention, the counter element is covered by an elastic layer. Accordingly, a "universal" counter element is formed which does not have to be exchanged or adapted when a different creasing plate is mounted to the creasing tool. Rather, the elastic layer acts in the manner of a "die" when the creasing projection deforms the carton, cardboard or foil.

The elastic layer can be made from rubber or an elastomer such that the elasticity and hardness of the elastic layer can be very easily adapted to the particular requirements.

In an alternative embodiment, the counter element is covered by a layer made from a shape memory material. The shape memory material allows using the counter cylinder similar to a die which has depressions which are the counterpart to the creasing projections on the creasing plate. The depressions can very conveniently be obtained by rotating both cylinders in a condition in which the creasing plate is firmly pressed against the surface of the counter cylinder, thereby creating the depressions by means of the creasing projections. When the current creasing job is finished, the depressions can be "erased" because of the shape memory effect of the material so that a "fresh" counter cylinder with a smooth cylindrical surface is available.

According to an embodiment of the invention, a driving fillet is provided on the creasing plate, the driving fillet extending along the majority of the circumference of the creasing cylinder. The driving fillet is chosen regarding its height such that it exerts a constant driving force on the sheets advanced through the creasing area between the cylinders, ensuring that the sheets are properly driven irrespective of the creasing projections on the creasing plate.

The driving fillet can be formed by a plastically deformed portion of the creasing plate in a manner similar to the creasing projections, or can be generated by adding a strip of material onto the creasing plate, e.g. from an epoxy material. This adds flexibility as the suitable height, widths and location of the driving fillet can be set for each new creasing job and the creasing plate used therefore.

According to an embodiment of the invention, the creasing plate blanks are pre-cut. As the creasing machine usually has a dedicated creasing tool, it is not necessary to be flexible regarding the dimensions of the creasing plate. Rather, the manufacturing times for the creasing plate can be reduced by precutting the creasing plate blanks before sending them to the punching module.

Figure 2:
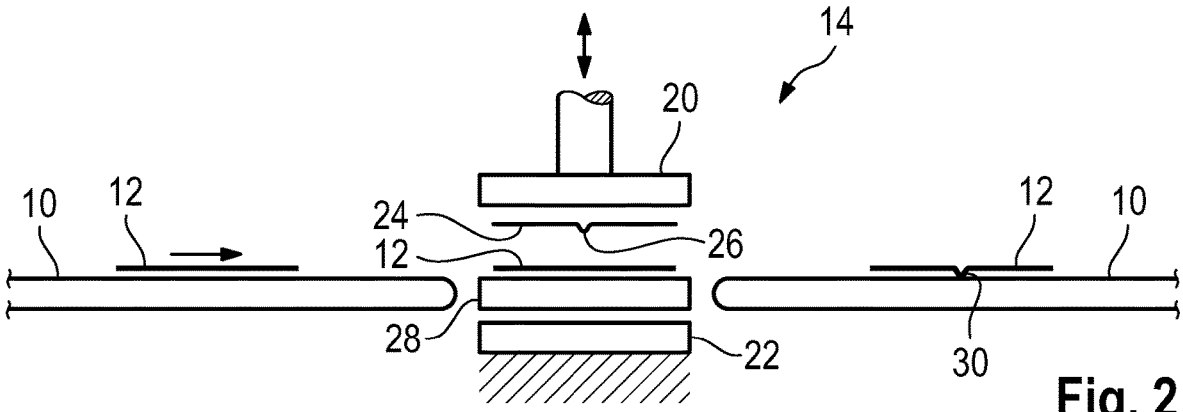
Figure 3:
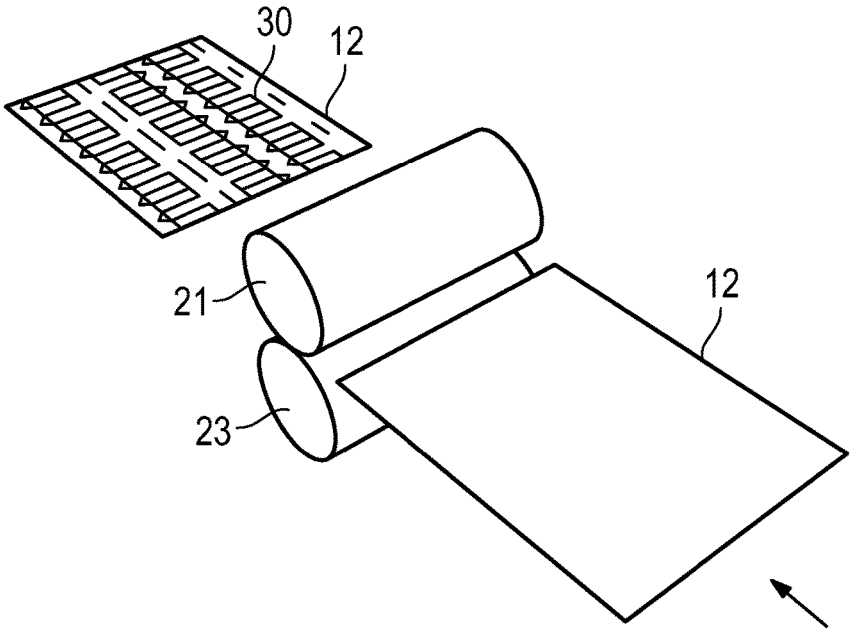
Figure 4:
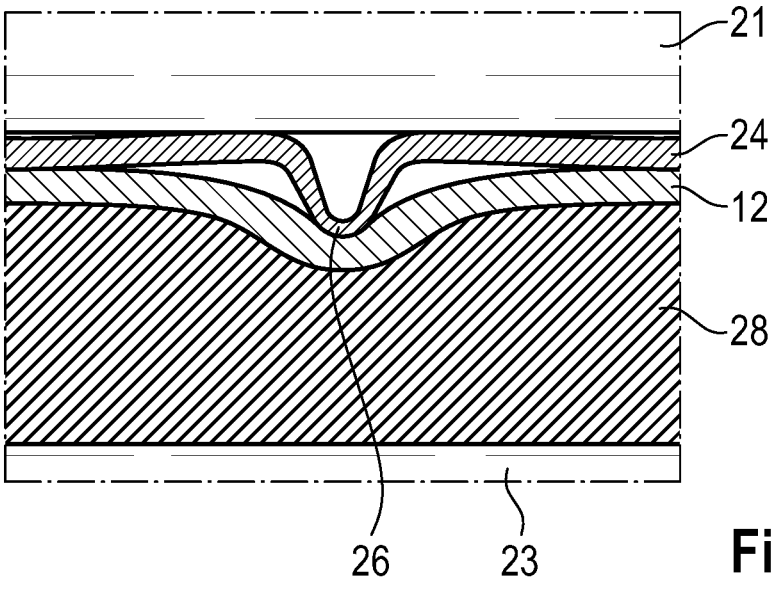
Figure 5:
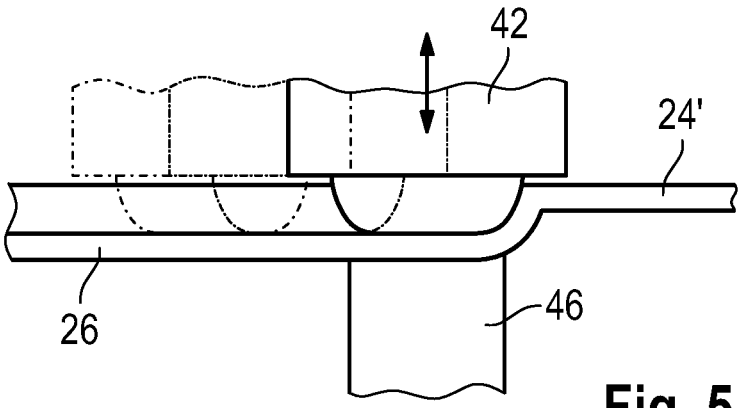
Figure 6A:
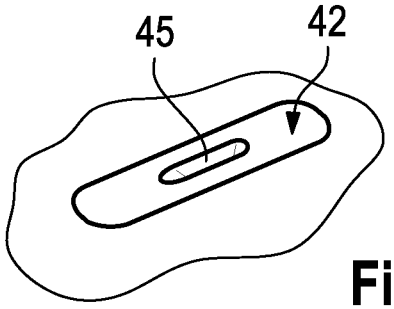
Figure 6B:
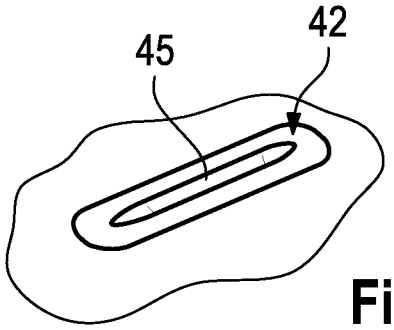
Figure 6C:
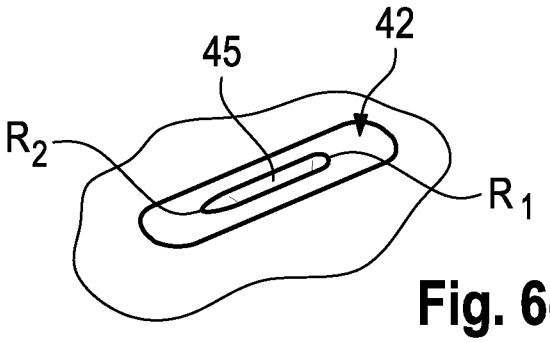
Figure 10:
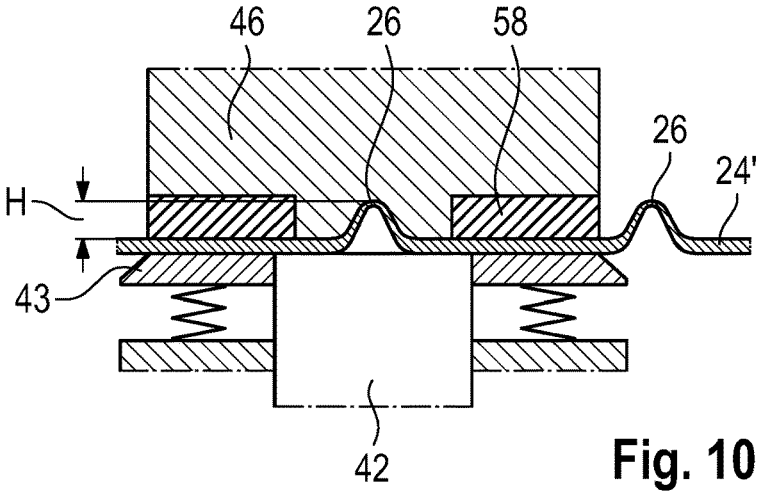
Figure 11A:
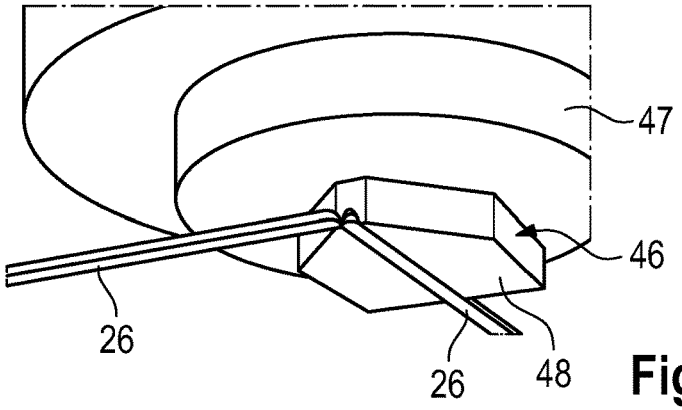
Figure 11B:
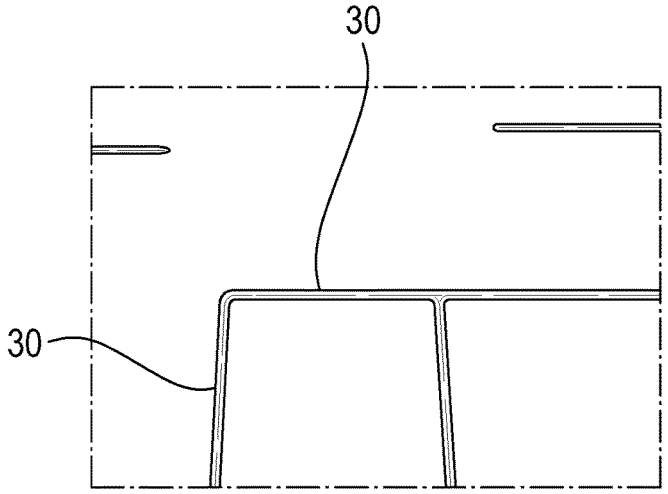
Figure 12A:
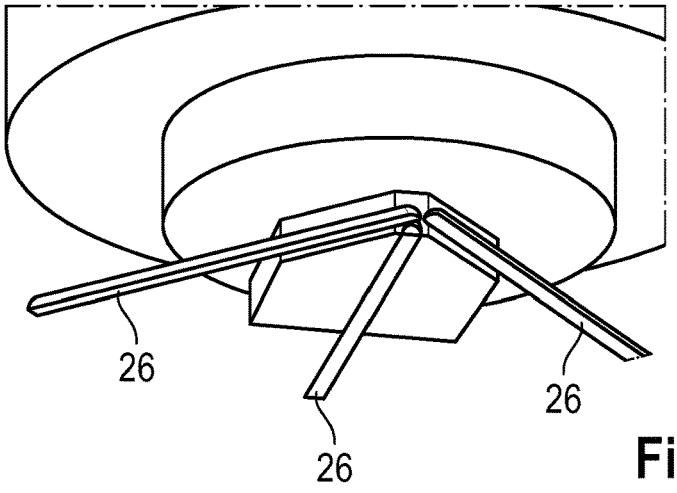
Figure 12B:
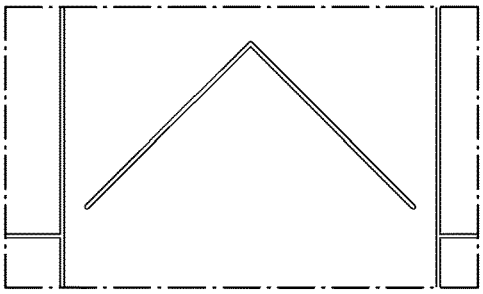
Figure 12C:
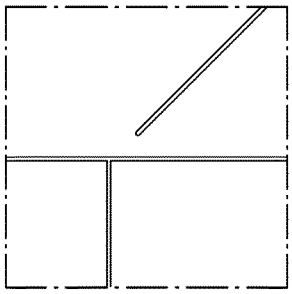
Figure 12D:
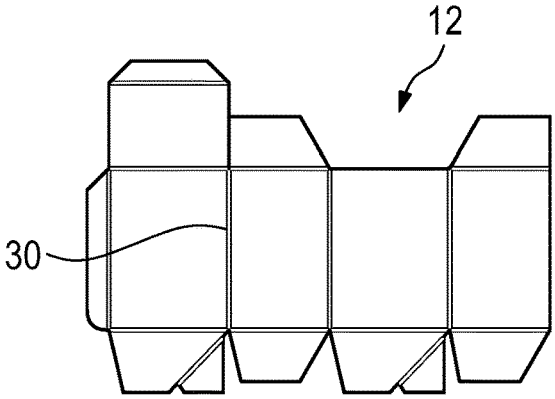
Figure 12E:
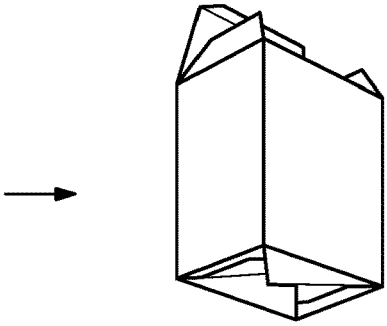
Figure 13A:
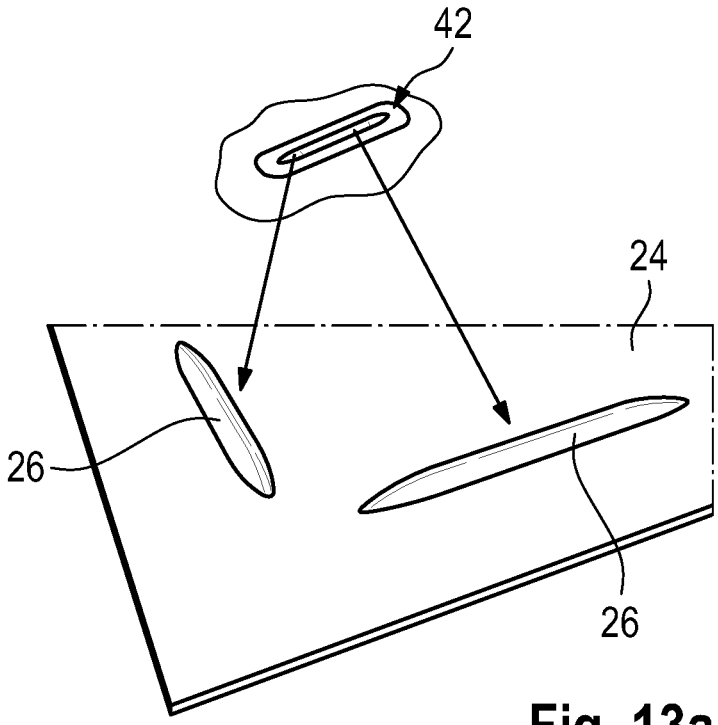
Figure 13B:
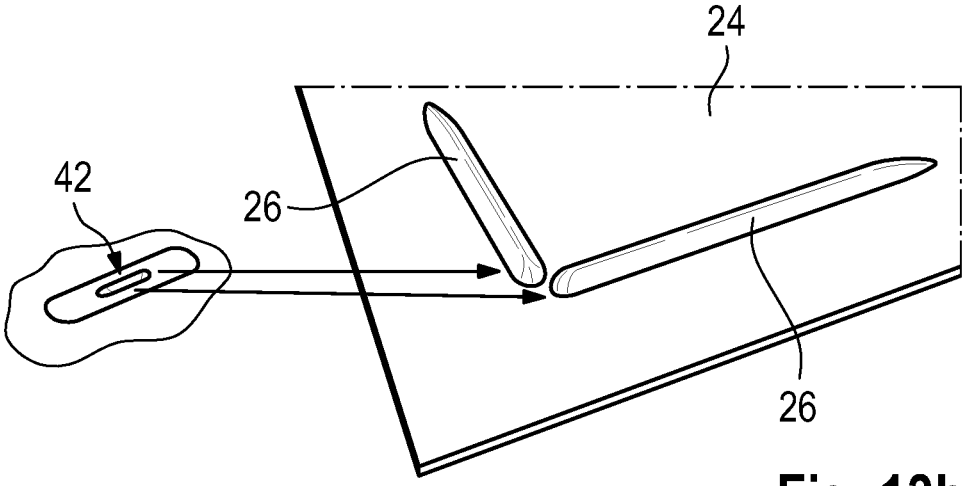
Figure 15A:
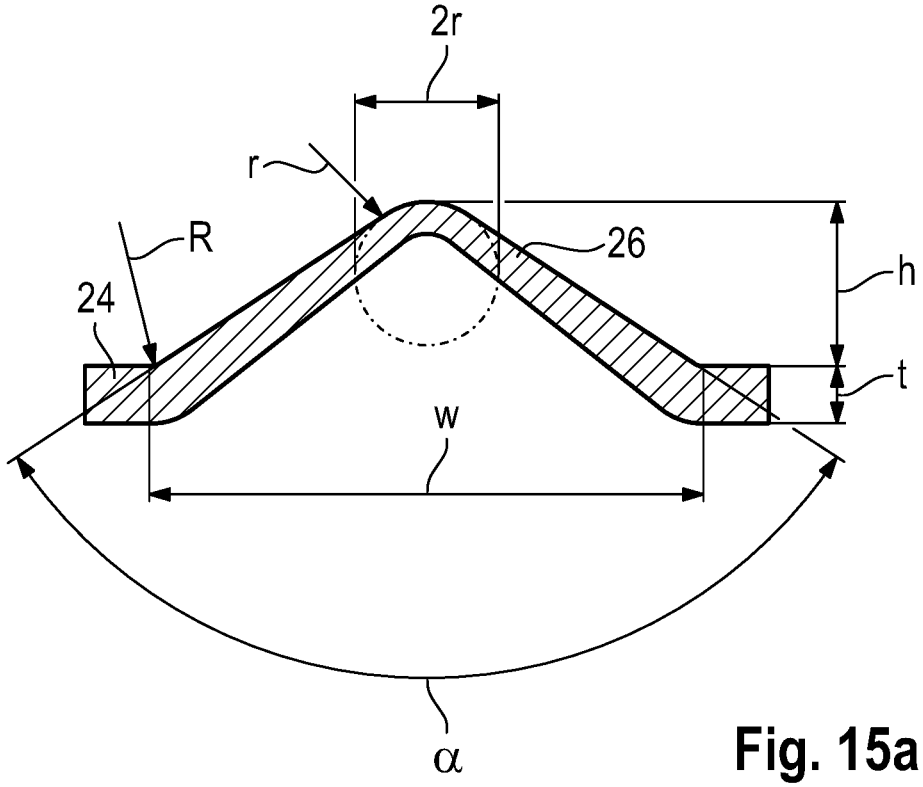
Figure 15B:
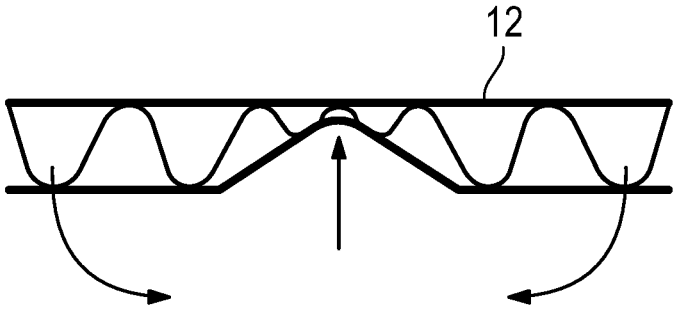
Figure 16B:
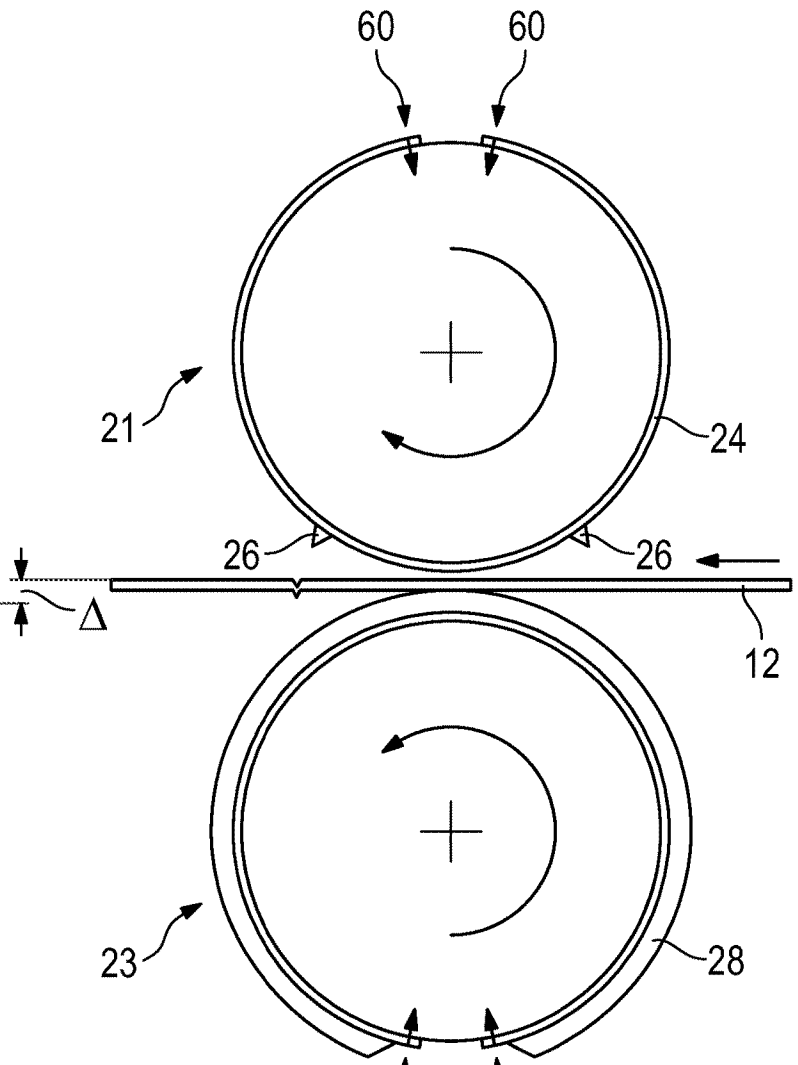
Figure 16A:
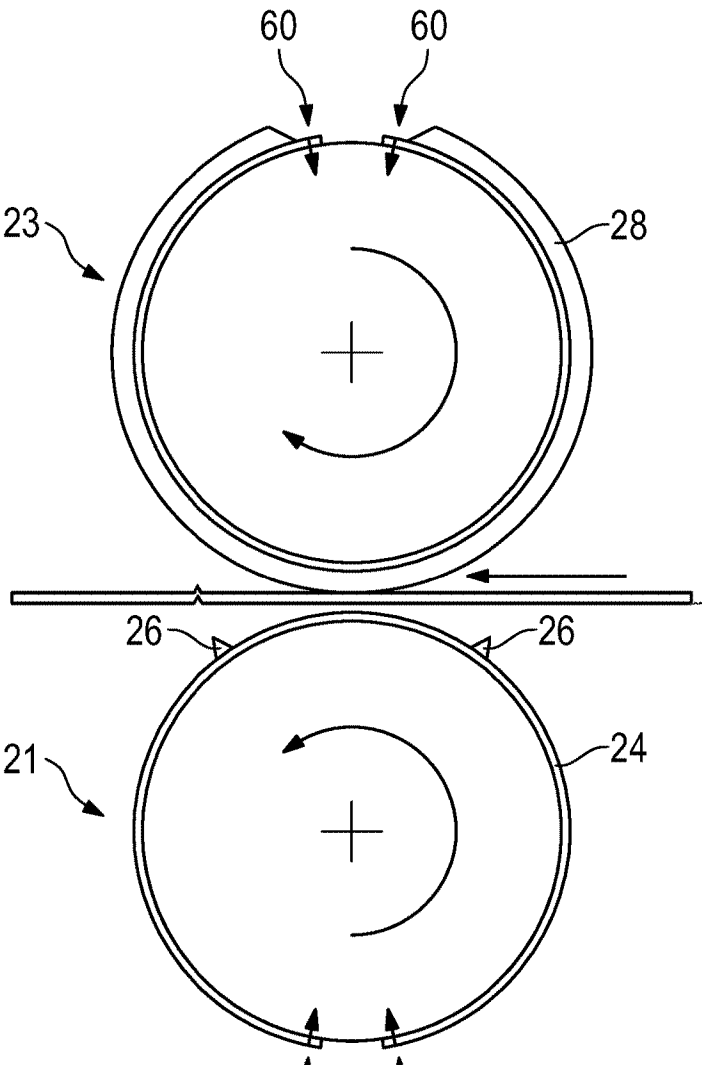
Figure 17:
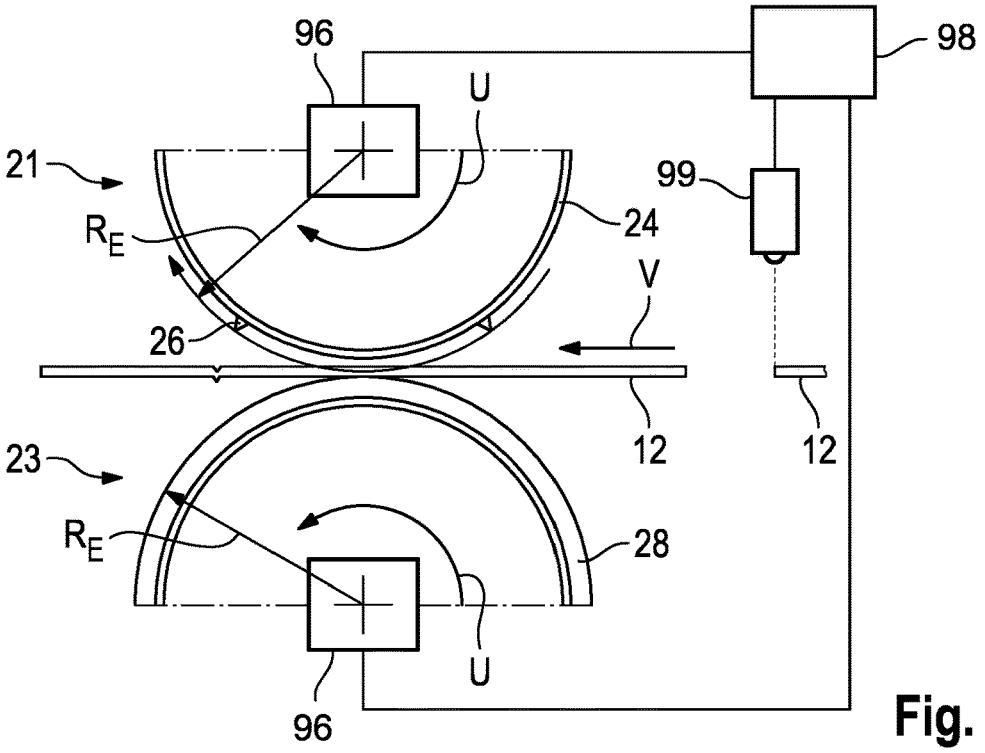
Figure 18:
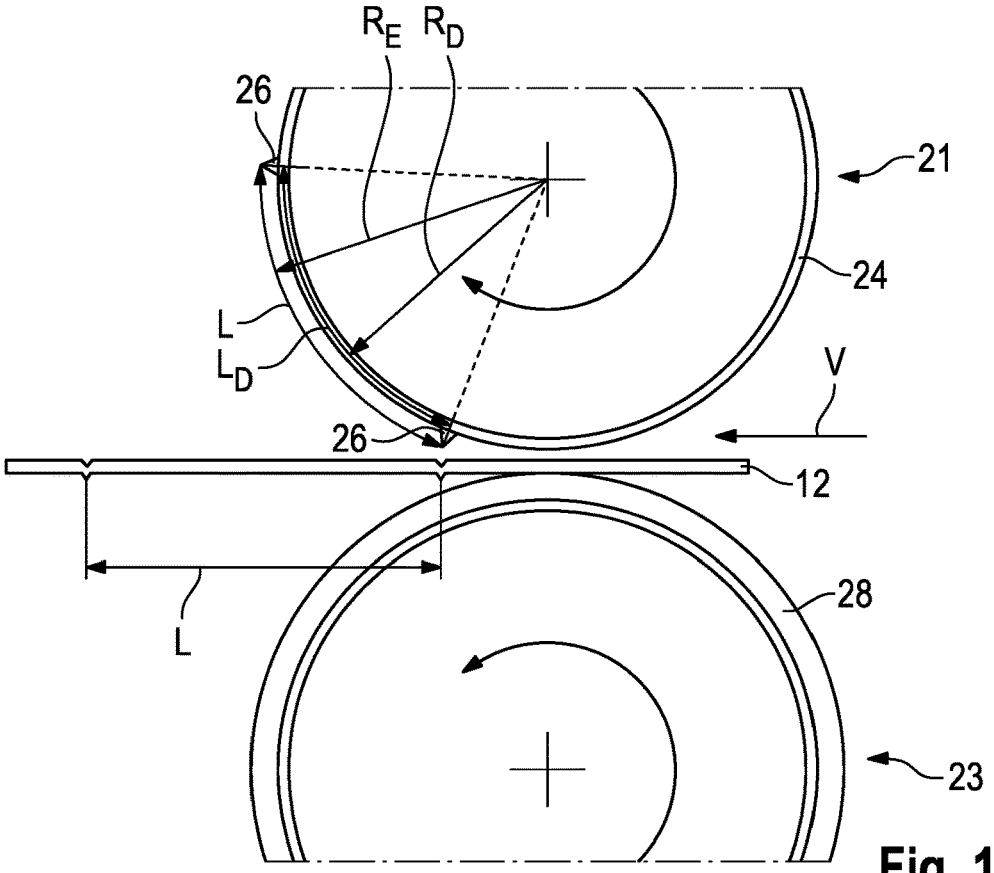
Figure 19:
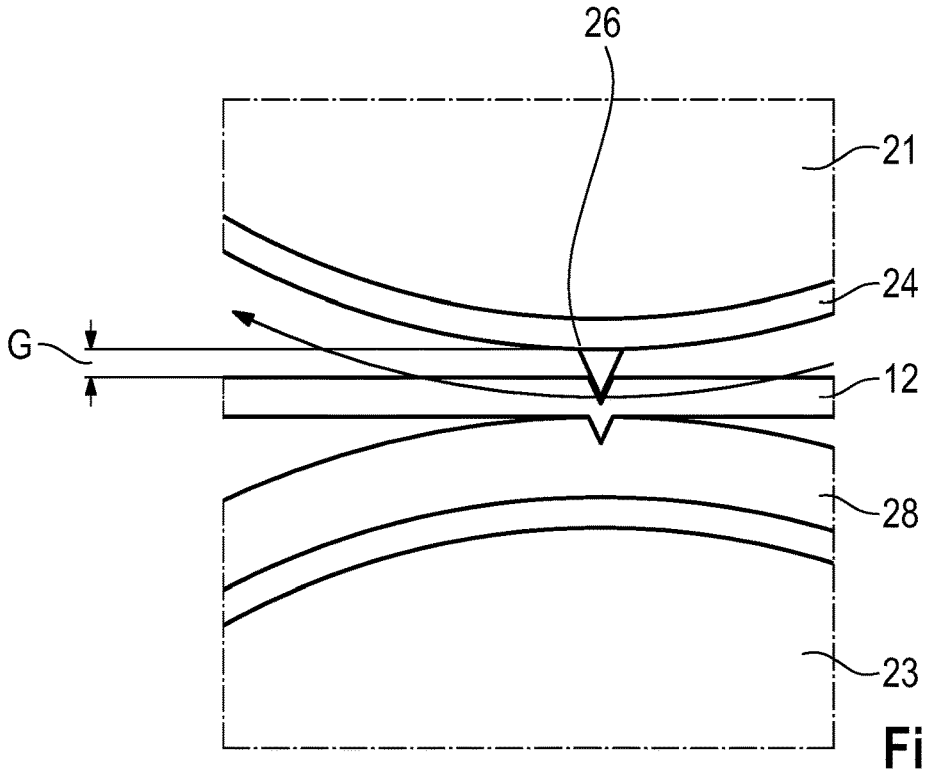
Figure 20A:
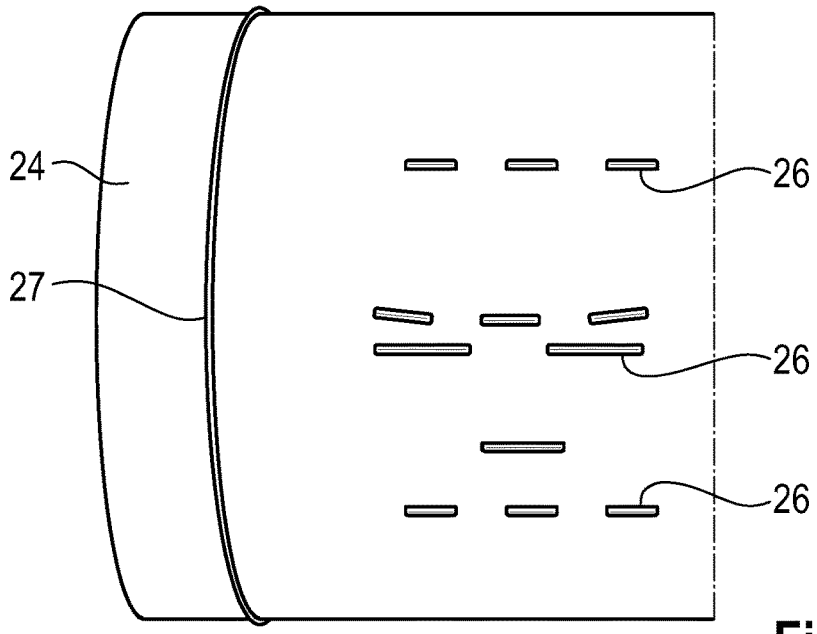
Figure 20B:
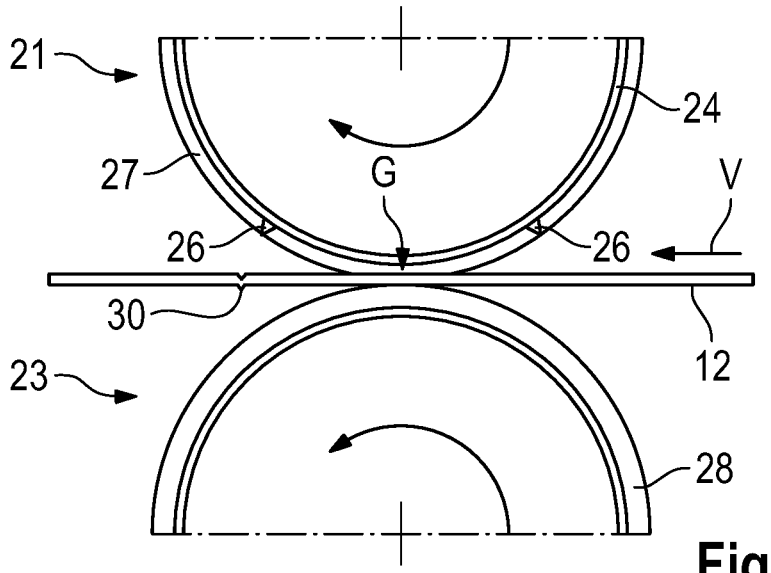
Figure 20C:
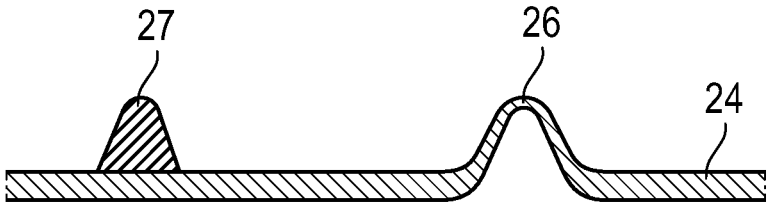
Figure 21A:
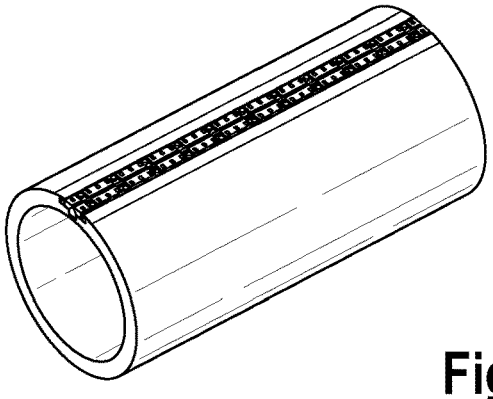
Figure 21B:
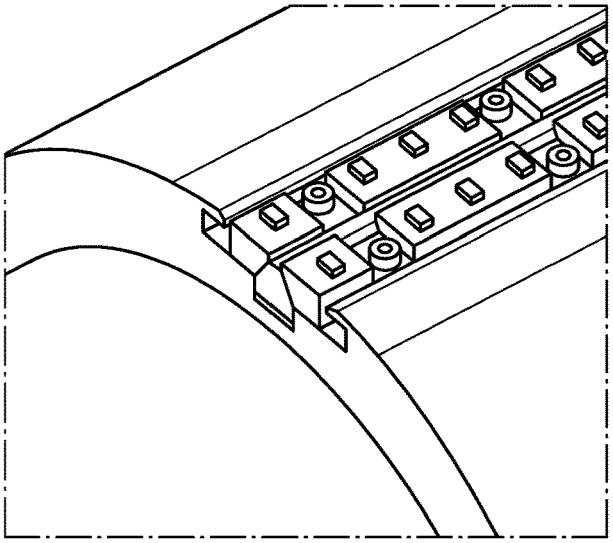
Figure 21C:
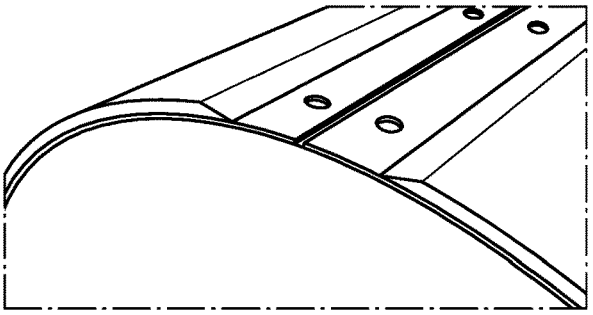

The invention will now be described with reference to the enclosed drawings. In the drawings, FIG. 1 schematically shows a creasing machine, FIG. 2 schematically shows one embodiment of the creasing tool used in the creasing machine of FIG. 1, FIG. 3 schematically shows a second embodiment of a creasing tool used in the creasing machine of FIG. 1, FIG. 4 shows a cross section through a creasing plate mounted to the creasing tool and generating a folding crease by pressing the sheet against the counter element, FIG. 5 schematically shows the process of creating a creasing projection on a creasing plate, FIGS. 6*a* to 6*c* show three different embodiments of punches used in the creasing machine of FIG. 1, FIGS. 7*a* and 7*b* show a first embodiment of a die used in the creasing machine of FIG. 1, FIG. 8 shows a second embodiment of the die used in the creasing machine of FIG. 1, FIG. 9 shows a die according to the prior art, FIG. 10 shows a cross section through a punch and a die when deforming a creasing plate blank, FIGS. 11*a* and 11*b* schematically show the die of FIGS. 7*a* and 7*b* when generating two merging creasing projections, and the folding creases generated with these folding projections, and FIGS. 12*a* to 12*e* schematically show the die of FIGS. 7*a* and 7*b* used for manufacturing three merging folding projections, and the folding creases generated with these creasing projections as well as a corresponding blank cut from a sheet and a box manufactured from the blank, FIGS. 13*a* and 13*b* show in more detail creasing projections obtained with the punches of FIGS. 6*b* and 6*c*, FIGS. 14*a* and 14*b* show a cross section through creasing projections used for creasing carton, FIGS. 15*a* and 15*b* show in a cross section a creasing projection used for creasing corrugated carton and the crease obtained therewith, FIGS. 16*a* and 16*b* show the creasing tool of FIG. 3 in a first and in a second condition, FIG. 17 schematically shows the creasing tool in more detail in combination with a control of the speed of rotation of the cylinders, FIG. 18 shows a schematic cross section through the creasing tool for explaining the speed of rotation of the cylinders, FIG. 19 shows at a larger scale the area of contact between the two cylinders of the creasing tool and the sheet to be provided with the creases, FIGS. 20*a* to 20*c* show a top view on a creasing plate, a cross section through the creasing tool provided with a driving fillet and a cross section through part of a creasing plate provided with a driving fillet and a creasing projections, FIGS. 21*a* to 21*c* show a perspective view of a cylinder used in the creasing tool, an enlarged view of the clamping mechanism used for clamping the creasing plate and used for clamping the elastic layer of the counter cylinder, FIGS. 22*a* to 22*g* show different steps of using a counter cylinder according to an alternative embodiment, FIGS. 23*a* to 23*d* show the cylinder used in the creasing tool in more detail, and FIGS. 24*a* and 24*b* show the counter cylinder in more detail.

In FIG. 1, a creasing machine is schematically shown. It comprises a transportation system 10 for advancing sheets 12 through a creasing area 14 where folding creases can be applied to the sheets 12.

Additional processing stations 16, 18 may be provided as part of the creasing machine or associated therewith. Processing stations 16, 18 can be used for cutting, folding, gluing or otherwise processing the sheets 12 or articles produced therewith.

Sheets 12 can be made from cardboard, carton or foil, and they can later be processed so as to cut blanks from the sheets to form a package, a box, a wrapping, an envelope or a similar product.

Sheets 12 can be supplied to creasing area 14 either separately as shown in the Figure, or in the form of a continuous web guided through creasing area 14.

It is also possible to integrate into creasing area 14 a cutting system which allows separating the individual blanks from the sheet.

In creasing area 14, a creasing tool and a counter element cooperate so as to apply at least one folding crease to sheet 12. To this end, the creasing tool carries a creasing plate, the creasing plate being provided with creasing projections. The geometry and arrangement of the creasing projections on the creasing plate corresponds to the folding creases to be applied to the sheet.

A first example of the creasing tool and the counter element used in creasing area 14 is shown in FIG. 2.

The creasing tool is here in the form of a plunger 20 which can be advanced towards and pressed against a counter element 22. At plunger 20, a creasing plate 24 is mounted which is provided with at least one creasing projection 26. Only a single creasing projection 26 is shown here for increased clarity.

On the side facing plunger 20, counter element 22 is provided with an elastic layer 28 which preferably is formed from rubber or an elastomer.

The sheets 12 to be provided with a folding crease are advanced with transportation system 10 so as to be positioned between plunger 20 and counter element 22. Plunger 20 is then pressed against elastic layer 28 whereby creasing projection 26 creates a folding crease 30 by locally deforming sheet 12.

A second embodiment of the creasing tool and the counter element is shown in FIG. 3. Here, the creasing tool is provided in the form of a creasing cylinder 21, and the counter element is in the form of a counter cylinder 23. Accordingly, creasing plate 24 is curved, and elastic layer 28 is cylindrical.

The folding creases 30 are generated by advancing sheet 12 through the gap between creasing cylinder 21 and counter cylinder 23.

The interaction between creasing plate 24 and sheet 12 is shown in more detail in FIG. 4.

Creasing projections 26 are formed at creasing plate 24 by repeatedly and locally deforming the material of creasing plate 24 so as to generate the creasing projections 26 in the desired pattern. In order to allow for the desired plastic deformation, creasing plate 24 is formed from steel, in particular from carbon steel or stainless steel. It preferably has a thickness in the order of 0.2 to 0.6 mm.

For generating the creasing projections 26, a punching module 40 is provided, in particular a turret punching machine or a coil punching machine. Punching machines of these types are generally known. They however are preferably slightly adapted for being used in combination with the creasing machine. In particular, punching module 40 may not be as versatile and powerful as a conventional punching machine as it only has to perform a very limited number of different operations (namely generating generally straight creasing projections) in a rather thin material.

Punching module 40 is schematically shown in FIG. 1 with a punch 42 used for plastically deforming a creasing plate blank 24'.

Further, punching module 40 comprises a turret 44 in which a plurality of different punches 42 is stored.

FIG. 5 schematically shows how punching module 40 generates a creasing projection 26 by repeatedly plastically deforming creasing plate blank 24'. With full lines, punch 42 is shown which cooperates with a die 46 positioned on the opposite side of creasing plate blank 24'. With dashed lines, the position of punch 42 during the previous punching stroke is shown, and dotted lines indicate the position of punch 42 during the again proceeding punching stroke.

Each stroke generates a small, plastically deformed area at the creasing plate blank 24', with the entirety of the plastically deformed areas forming the creasing projection(s) 26.

FIGS. 6*a* to 6*c* show different embodiments of the punch arranged on a carrier 43.

In FIG. 6*a*, a punch 42 with a comparatively short projecting portion 45 is shown. The length of the projecting portion can be in the order of one centimeter.

At its ends which are opposite each other when viewed along the longitudinal direction of the projecting portion 45, comparatively small radii are provided. They can be in the order of 0.2 to 2 millimeters.

In FIG. 6*b*, a punch 42 is shown in which the projection portion 45 is approximately three times the length of the projecting portion 45 of the punch 42 shown in FIG. 6*a*. It can be seen that the radii at the opposite ends of the projecting portion are comparatively large.

In FIG. 6*c*, a punch 42 is shown which has different radii at the opposite ends of the projecting portion 45. There is a small radius $R_1$ which is a in the order of 0.2 to 2 millimeters only, and there is a large radius $R_2$ which can be in the order of 2 to 15 millimeters.

The height H (please see also FIG. 10) with which the projecting portion 45 projects over the forward end face of punch 42, is in the order to 1 to 2 mm.

FIGS. 7*a* and 7*b* show an embodiment of die 46 adapted for cooperating with punch 42 and mounted on a carrier 47.

Die 46 has a support surface 48 at which creasing plate blank 24' may abut during the punching operation. Within support surface 48, a recess 50 is provided. Recess 50 is sized so as to receive the plastically deformed material of creasing plate blank 24' forming the creasing projection 26.

As can be seen in FIGS. 7*a* and 7*b*, recess 50 is open at its opposite ends.

It can further be seen in FIG. 7*a* that the outer contour of die 46 adjacent one of the open ends of recess 50 extends inclined with respect to the longitudinal direction of recess 50. In particular, the outer contour at each side of recess 50 extends at an angle of 45° with respect to the longitudinal direction of recess 50.

At the opposite end of recess 50, the outer contour of die 46 extends perpendicularly with respect to the longitudinal direction of recess 50.

An elastic ejector 58 is arranged at die 46. Ejector 58 is formed as a plate from rubber or an elastomer and snugly surrounds die 46 so that it stays at the position shown in FIG. 7*b* without any additional measures.

In FIG. 8, a different embodiment of die 46 is shown. Here, die 46 has the inclined contour at both open ends of recess 50 (please see the portions to which arrows P point).

In FIG. 9, a conventional die 46 is shown which has a circular support surface 48.

In FIG. 10, a schematic cross section through the punch 42 cooperating with die 46 is shown.

The creasing plate blank 24' is held, during the process of locally plastically deforming it so as to create the creasing projections 26, between die 46 and the carrier 43. Carrier 43 is here spring loaded towards die 46 so as to act in the manner of a clamp.

This avoids tension in the creasing plate blank 24' which could result in unwanted deformations.

In FIGS. 11*a* and 11*b*, it is schematically shown how adjacent creasing projections 26 can be formed by means of the punch cooperating with die 46. For better clarity, the punch and the creasing plate are not shown in FIG. 11*a*. Rather, only creasing projections 26 formed at creasing plate 24 are shown.

The creasing projection 26 extending towards the left in FIG. 11*a* is a projection which was previously formed. The creasing projection 26 extending through the recess in die 46 is the creasing projection currently formed together with punch 42. It can be seen that the "new" creasing projection 26 can be formed to a point where it is immediately adjacent the "old" creasing projection 26.

The result of the immediately adjacent creasing projections 26 is visible in FIG. 11*b* where folding creases 30 are shown which are arranged at a 90° angle with respect to each other and which almost merge into each other. Since very little uncreased material remains in the corner between the folding creases 30, a very precise fold can be achieved in this area.

In FIGS. 12*a* to 12*e*, it is shown how three creasing projections 26 can be formed at a creasing plate. Due to the particular contour at one of the open ends of recess 50, the three creasing projections 26 can almost merge into each other at an intersection point. It can be seen in FIG. 12*d* where such creasing projections 26 can be used for forming folding creases 30 at a sheet 12.

These creasing projections are aimed to fold a composite flap of a crash lock bottom box or of a four corner or six corner tray.

Punching module 40 is capable of producing different creasing plates 24 by appropriately deforming a creasing plate blank 24' at the required locations. It is in particular possible for the creasing machine, in particular for a schematically shown control 90 of the creasing machine, to determine, upon receipt of data for a new creasing job, whether a new creasing plate 24 is to be manufactured or whether an "old" creasing plate used in a previous creasing job can be used. Depending on the determination, control 90 either initiates that punching module 40 manufactures a new creasing plate 24, or that the "old" creasing plate 24 is retrieved from an inventory 92 where the previously manufactured creasing plates 24 are being stored.

The creasing plate 24 (either newly manufactured or retrieved from inventory 92) is taken over by handling system 94 and is then mounted at the creasing tool.

If the creasing tool is a punch, the plate is mounted in a flat shape. If the creasing tool is a creasing cylinder, creasing plate 24 can be either bent and clamped to creasing cylinder 23, or a circumferentially closed creasing sleeve can be formed which can then be mounted to creasing cylinder 23.

As is explained above, a punch having larger radii at opposite sides (to be precise: having larger radii at opposite sides of its projecting portion 45) is used for obtaining creasing projections 26 which have a smooth transition between the material deformed with each stroke of the punch. FIG. 13*a* shows creasing projections 26 which terminate at a larger distance from each other. The creasing projections 26 very smoothly merge into the creasing plate 24.

FIG. 13*b* shows two creasing projections 26 which terminate in a very small distance from each other so as to almost merge into each other. These creasing projections 26 are obtained by using a punch 42 which has at least at its "forward" end (referring to the direction in which the creasing plate blank 24' is displaced during consecutive strokes) a small radius. The small radius allows for a comparatively steep rise of the creasing projection 26 from the creasing plate 24 so that a small distance between adjacent ends of the creasing projections 26 is possible.

It can be seen that the ends of the creasing projections which are at the opposite ends, terminate with a larger radius.

Figure 14A:
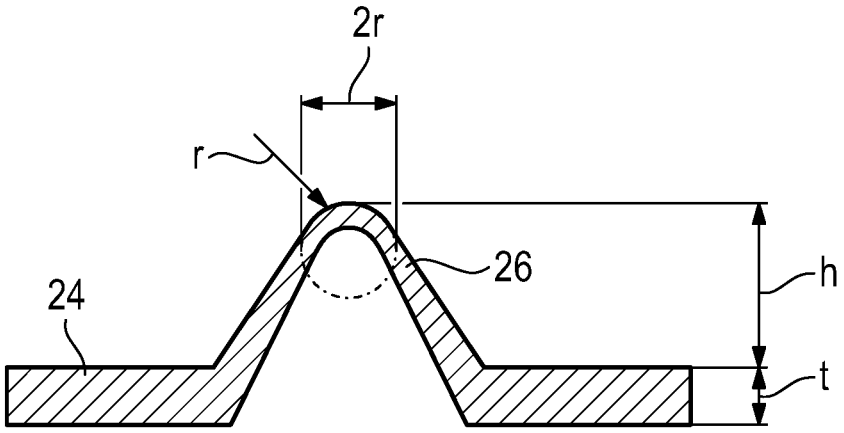
Figure 14B:
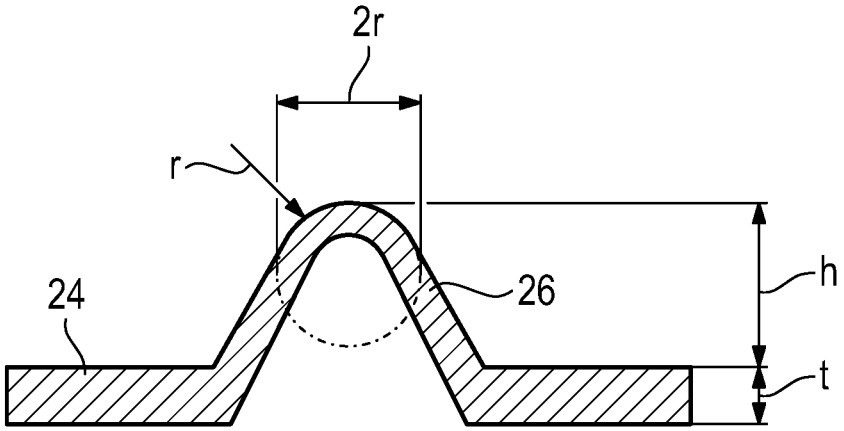

FIGS. 14*a* and 14*b* show cross sections through creasing projections 26 which have been proven to be very effective for creasing carton.

In FIG. 14*a*, the creasing plate has a thickness in the range of 0.4 mm while the height h of the creasing projection is in the range of 0.6 to 1.6 mm.

Depending from the particular carton to be creased, the radius R at the apex of the creasing projection 26 can be in the range of 0.25 to 0.7 mm. In other words, the apex matches an inscribed circle with a diameter of 2R.

Preferred values for the height h are in the region of 1.2 mm, while preferred radii can be 0.35 mm and 0.525 mm.

In FIG. 15*a*, a creasing projection 26 for creasing corrugated cardboard is shown. It can be seen that a much wider creasing projection is used as compared to the profiles shown in FIGS. 14*a* and 14*b*. In particular, the angle $\alpha$ is more than 90°. According to a preferred embodiment, this angle can be in the range of 110 to 120°, in particular 114°.

The wider conical shape of the profile of creasing projection 26 is effective to compress the carton on each side of the crease so as to create the space which is necessary for folding the corrugated cardboard (because of its increased thickness), thereby reducing the tension which is generated when the carton is folded.

Here again, a typical height of the creasing projection 26 is in the region of 1.2 mm. As the radius R at the apex of the profile, a value in the order of 0.5 to 0.6 mm is suitable, in particular 0.53 mm.

As a radius R at the base of creasing projection 26, a value in the order of 0.5 mm has been proven to be beneficial.

An inscribed circle here again can have a diameter of 1.05 mm.

It is important to note that the creasing projections 26 on one and the same creasing plate 24 can have different heights, depending from the particular requirements.

FIGS. 16*a* and 16*b* show an advantageous aspect of the creasing tool.

When changing from creasing cardboard to creasing corrugated carton, it is necessary to change the crease direction. This can very easily be done by changing the function of the two cylinders 21, 23.

In FIG. 16*a*, the upper cylinder acts as the counter cylinder 23 while the lower cylinder is the creasing cylinder 21. Accordingly, the elastic layer 28 is mounted to the upper cylinder while creasing plate 24 is mounted to the lower cylinder.

In the configuration shown in FIG. 16*b*, this arrangement is reversed. The elastic layer 28 is mounted to the lower cylinder while creasing plate 24 is mounted to the upper cylinder. Thus, the upper cylinder acts as creasing cylinder 21 while the lower cylinder acts as counter cylinder 23.

It is however the same set of cylinders which is being used. The function of the cylinder is simply determined by the "tool" mounted to it (either creasing plate 24 or elastic layer 28). Accordingly, both cylinders are provided with identical clamping mechanisms (here very briefly indicated with reference numeral 60), and the cylinders have the same diameter.

The functional outer radius of both cylinders depends from the tool mounted to it. In particular, the functional outer radius of the cylinder provided with the elastic layer 28 is larger than the functional radius of the cylinder provided with creasing plate 24. Accordingly, the plane in which sheet 12 is advanced through the creasing area between the cylinders has to be adjusted depending from the particular configuration. The respective $\Delta$ is indicated between FIGS. 16*a* and 16*b*.

The vertical adjustment of the plane in which sheets 12 are provided can either be obtained by vertically adjusting the feeding device which advances the sheets, or by vertically adjusting the two cylinders 21, 23 with respect to the feeding plane.

Another consequence from the functional radius of the two cylinders being different is that the speed of rotation of the cylinders is slightly different as the tangential speed at the point of engagement at the sheets 12 has to be the same. Further, it has to match the speed with which the sheets 12 are advanced through the creasing tool.

In order to allow for an individual control of the speeds of rotation, each cylinder is provided with a servo motor 96 which is controlled by means of a machine control 98. Machine control 98 is also provided with a signal relating to the position of the clamping devices 60 as they form a dead zone where no creasing can be made.

Machine control 98 is furthermore provided with a signal relating to the position of the sheets 12 advanced through the creasing tool. This signal can be obtained via a sensor 99 which for example detects the leading edge of the sheets 12 upstream of the creasing tool.

Based on the effective radii $R_E$, the speed V with which the sheets 12 are advanced through the creasing tool, and the signal from sensor 99, machine control 98 suitably controls the servo motors 96 so as to achieve the proper speed of rotation U for each of the cylinders and also the correct position of the dead zone with respect to the individual sheets.

For manufacturing creasing plate 24, it has to be kept in mind that the creasing plate blanks 24' are deformed when being in a flat shape while the creasing plates are mounted, when installed on a creasing cylinder 21, in a curved shape. This results in the creasing projections 26 having, when the creasing plate is mounted to the creasing cylinder 21, a distance from each other which is larger than in the flat configuration of the creasing plate.

As can be seen in FIGS. 18 and 19, the creasing projections 26 are pressed into the carton to be creased by a certain distance (for example 1 mm) which however is less than the total height of the creasing projection. It is however preferred that the outer surface of creasing plate 24 does not touch the upper surface of sheets 12. Accordingly, a gap exists between the outer surface of creasing plate 24 and the upper surface of sheet 12.

FIG. 18 shows in an example the straight real length L between two creases 30, measured in parallel with the feeding direction of sheet 12. The same curved real length L can be measured between the apex of the corresponding creasing projections 26 on the functional, effective radius $R_E$. It can be seen that in a developed, flat condition of creasing plate 24, because of the difference between the development radius $R_D$ and the functional, effective radius $R_E$, the developed length Lo is less than the real length L. Accordingly, two creasing projections 26 have to be formed on the creasing plate 24 in a distance, parallel to the feeding direction, which is less than the actual distance which the respective creases shall have on sheet 12.

In FIGS. 20*a* and 20*b*, another aspect of the creasing tool is shown.

Typically, sheet 12 is driven between the creasing cylinder 21 and the counter cylinder 23 by the contact of the creasing projections 26 with the sheet and also because of the contact of the sheet with the counter cylinder. However, there are creasing configurations where at a certain point in time, no creasing projection 26 engages at sheet 12. Because of the gap G explained with reference to FIGS. 18 and 19, no proper driving force would be exerted onto sheet 12 in these points in time.

To ensure that sheet 12 is always positively driven irrespective of the particular position of creasing projections 26, a driving fillet 27 is provided which extends in a circular direction along the entire creasing plate 24. Driving fillet 27 can be a plastically deformed portion of creasing plate 24 in the same manner as the creasing projections 26.

It is however also possible to create driving fillet 27 in a different manner. As an example, an epoxy fillet could be added to the creasing plate in a separate manufacturing operation. Such driving fillet can be seen in FIG. 20*c*.

Driving fillet 27 does not have to project over the surface of creasing plate 24 in a manner which creates a distinct crease in sheet 12. The height can be chosen mainly in view of the intended driving force which shall be generated.

FIGS. 21*a* to 21*c* show the clamping mechanism 60 in more detail.

The clamping mechanism 60 is effective to anchor both ends of either creasing plate 24 or elastic layer 28 and force both ends towards each other equally. This ensures that the respective sleeve is correctly located around the cylinder. Further, this avoids problems with air pockets being trapped under the sleeve. Such air pockets could result in damage to the creasing plate 24 or the elastic layer 28 when the respective sleeve is put under pressure in operation.

FIGS. 22*a* to 22*g* show an additional aspect of the creasing machine.

In this embodiment, a sleeve of a shape memory material 29 is used on counter cylinder 23 instead of elastic layer 28. Shape memory material layer 29 is plastically deformed by means of creasing plate 24.

Figure 22A:
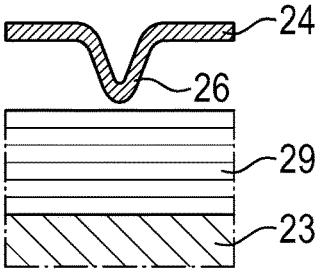

In FIG. 22*a*, creasing plate 24 has been mounted to creasing cylinder 21 while layer 29 having in a starting condition with a flat surface is mounted to counter cylinder 23.

Figure 22B:
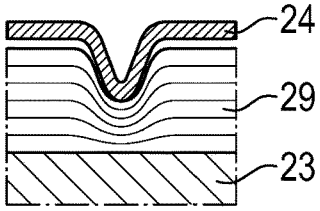

For shaping layer 29, the two cylinders 21, 23 are advanced towards each other so that creasing projections 26 on creasing plate 24 penetrate into layer 29 (please see FIG. 22*b*).

Figure 22C:
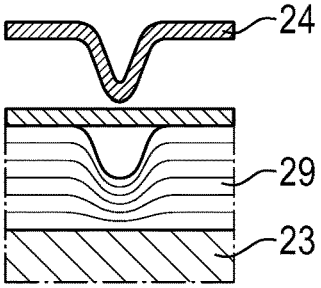

After increasing the distance between cylinders 21, 23 (and after curing, if necessary), layer 29 has the shape of a counter die to creasing plate 24 (please see FIG. 22*c*).

Figure 22D:
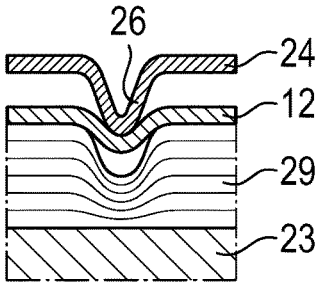
Figure 22E:
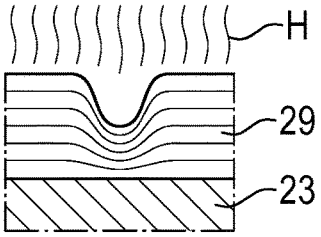
Figure 22F:
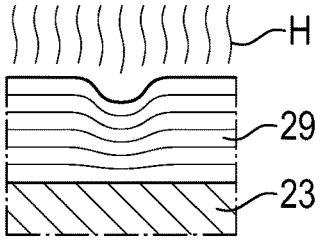
Figure 22G:
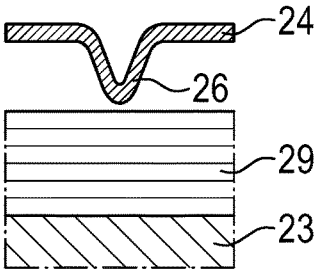

Subsequently, creasing cylinder 21 with creasing plate 24 and counter cylinder 23 with layer 29 can be used for creasing sheets 12 (please see FIG. 22*d*).

After a certain creasing job has been finished, layer 29 is restored to its original condition. To this end, layer 29 can be heated (schematically indicated with reference numeral H in FIGS. 22*e* and 220 so that the depressions in layer 29 are "erased".

When layer 29 has been restored to its original flat shape (please see FIG. 22*g*), the creasing machine is ready for the next creasing job which starts by creating a new counter die by deforming layer 29 with the new creasing plate 24.

Figure 23A:
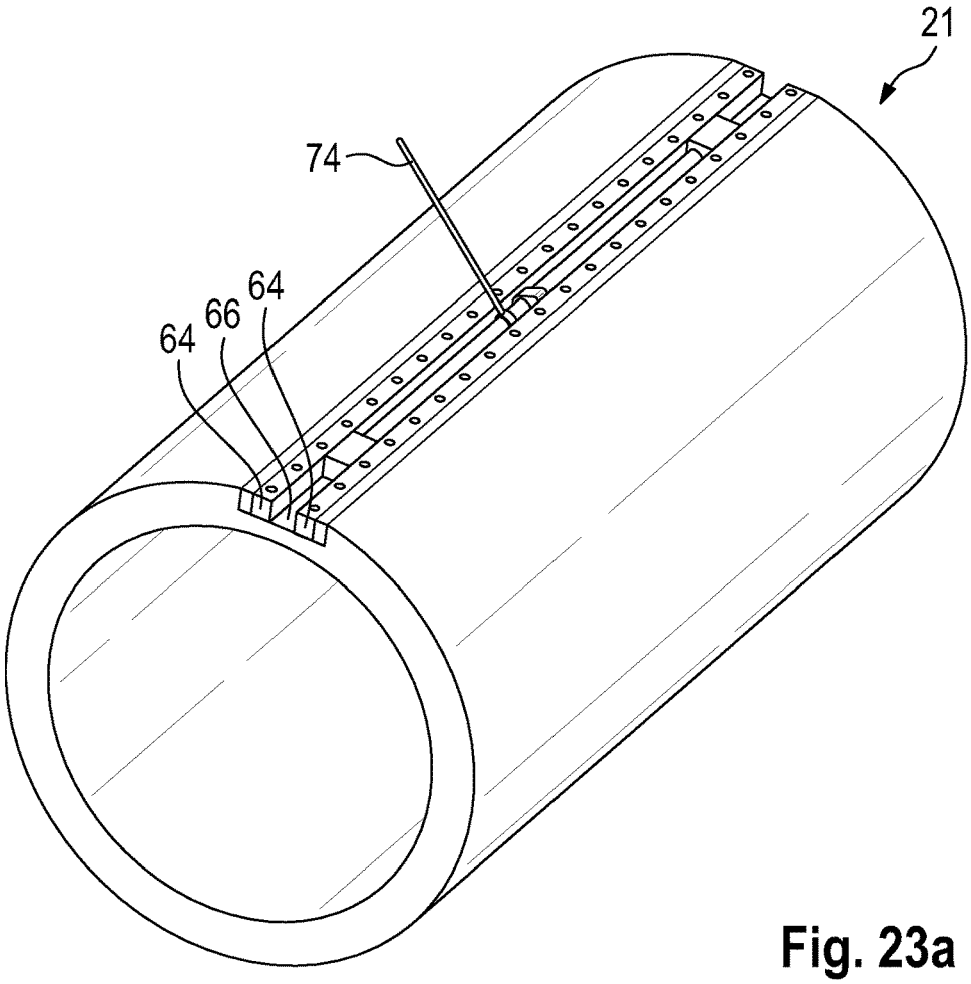
Figure 23B:
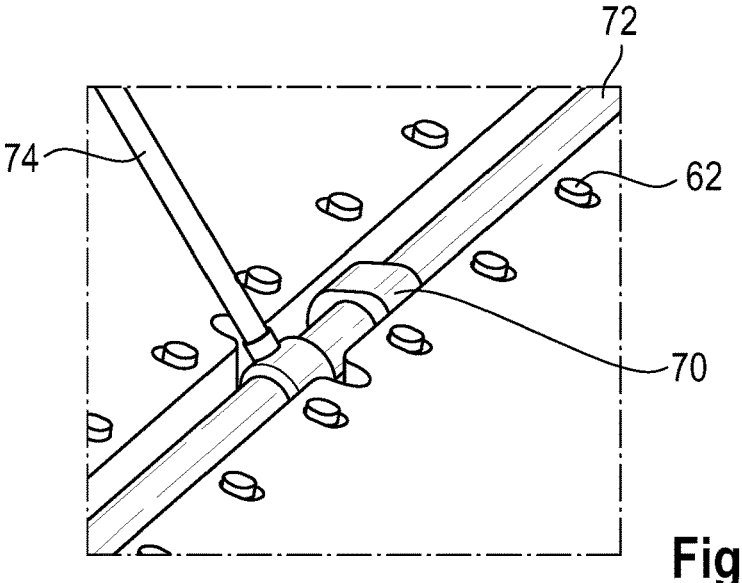
Figure 23C:
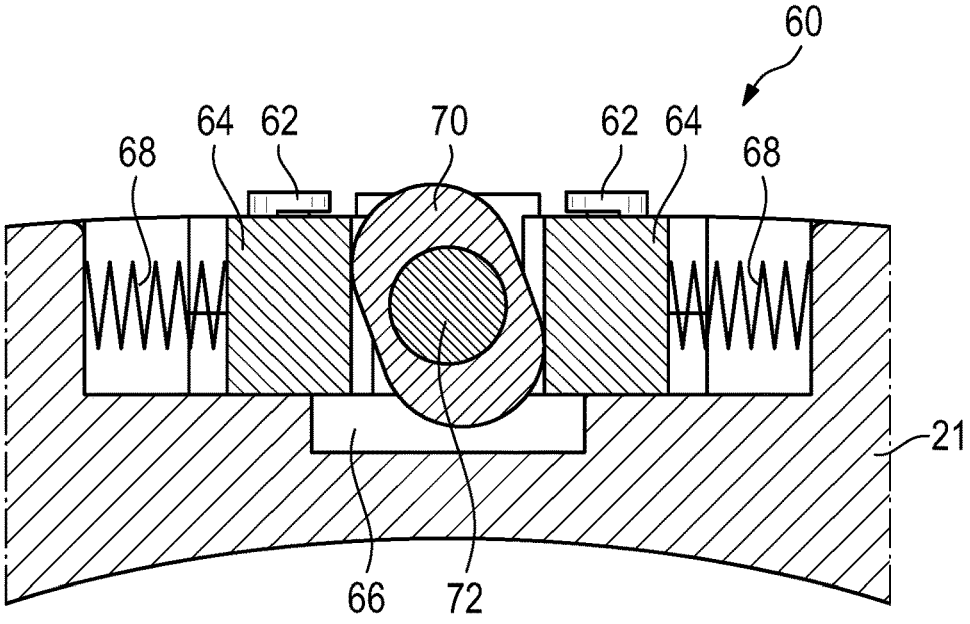
Figure 24A:
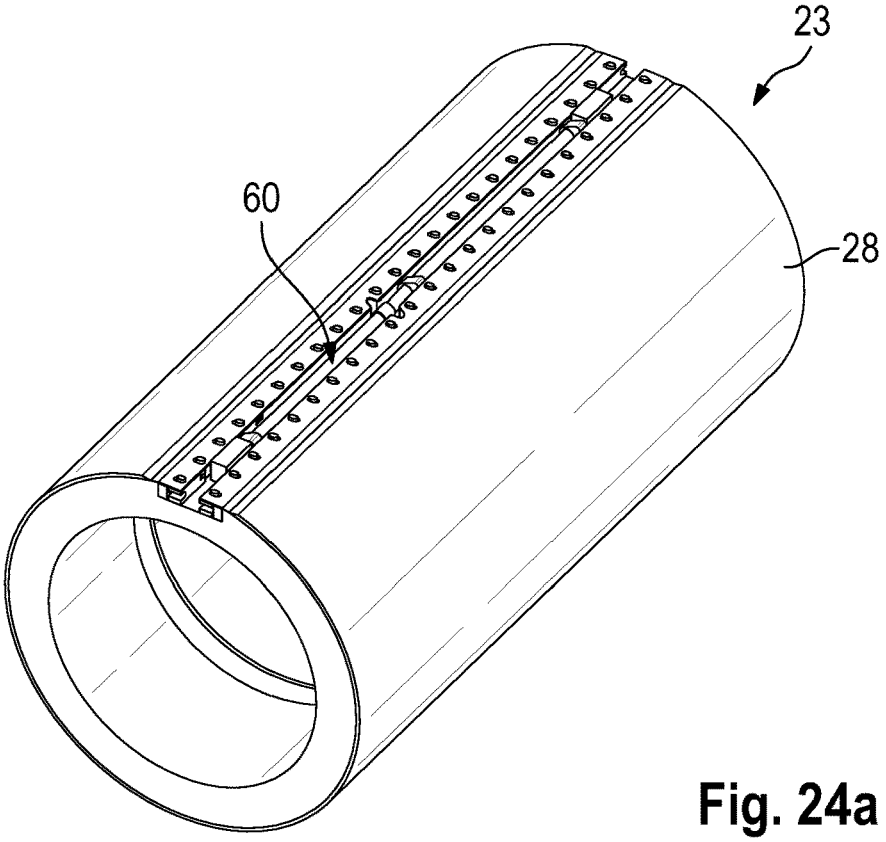
Figure 24B:
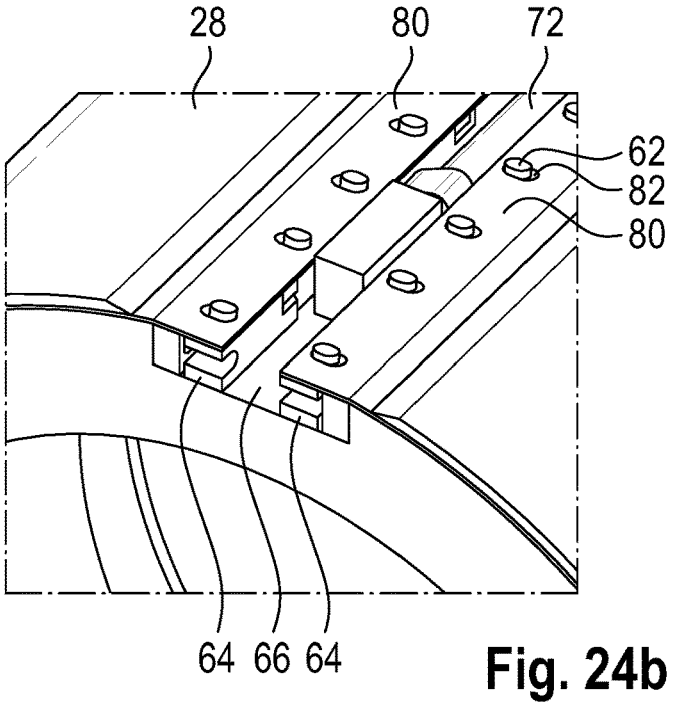

FIG. 23*a* shows the creasing cylinder 21 in more detail.

Figure 23D:
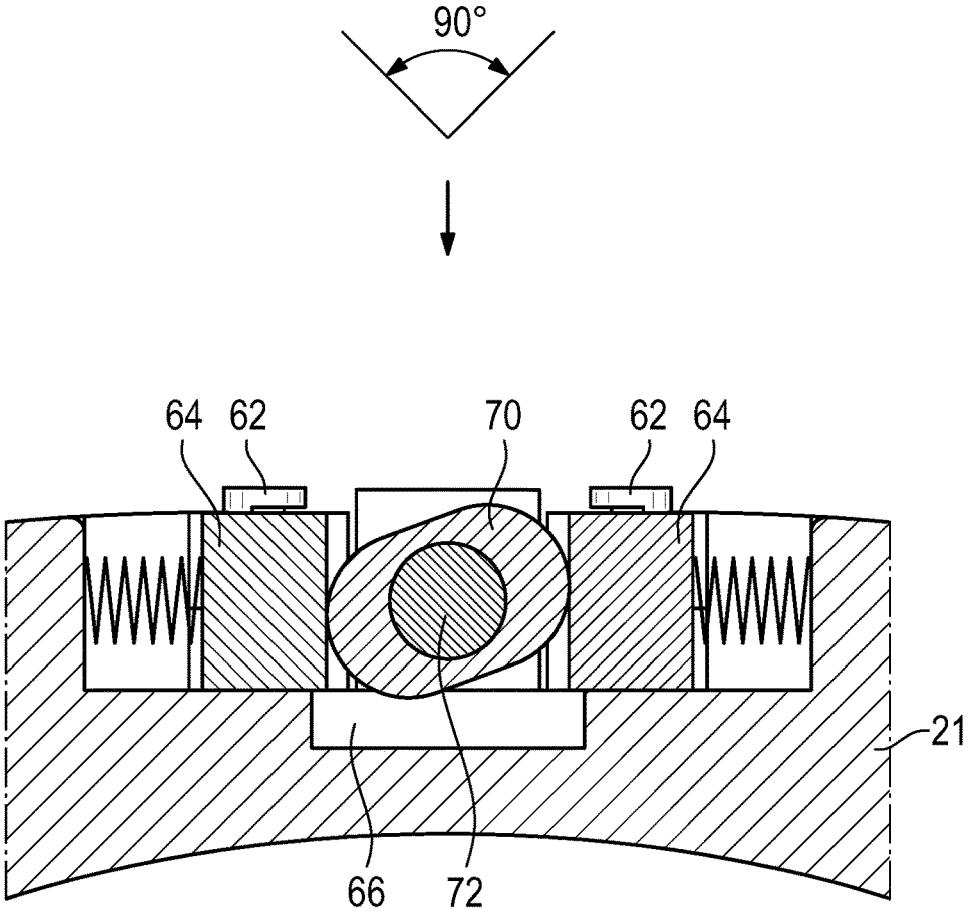

The clamping mechanism 60 has clamping pins 62 which are moveable between a clamping position (shown in FIG. 23*c*) and a release position (shown in FIG. 23*d*).

In the release position, the clamping pins 62 are spread apart as compared with the clamping position. Looking at FIGS. 23*c* and 23*d*, the distance between the clamping pins 62 in the clamping position is less than in the release position. In other words, a creasing plate 24 having holes into which the clamping pins 62 engage, is pulled to the outer circumference of the creasing cylinder when the clamping pins are in their clamping position.

The clamping pins 62 are mounted to sliding elements 64 which are arranged in a groove 66 formed in the creasing cylinder 21. The sliding elements 64 are biased by means of schematically shown springs 68 towards the center of the groove 66 and thus towards each other (and into the clamping position).

A release mechanism is provided for moving the clamping pins 62 from the clamping position into the release position. The release mechanism is here formed as a cam mechanism.

The cam mechanism has a plurality of cams 70 which are mounted non-rotatably on a shaft 72. The shaft is mounted rotatably in groove 66. Cams 70 are symmetrical with respect to the center of shaft 72. Thus, there are two apexes spaced by 180°.

Shaft 72 is provided with a bore for receiving an actuating tool 74 which can be a simple rod. The actuating tool 74 allows rotating the shaft and thus the cams 70 from the rest position shown in FIG. 23*c* to the spreading position shown in FIG. 23*d*.

In the rest position, the cams 70 do not exert notable forces on the sliding elements 64 so that they are urged by springs 68 towards each other into the clamping position.

In the spreading position, the cams urge the sliding elements 64 apart into the release position, against the force of the springs 68.

The amount of rotation of shaft 72 for transferring the cams 70 from the rest position into the spreading position is approx. 90°. It can be seen that in the spreading position, the cams 70 are moved "beyond" the dead center position in which the two apexes are arranged horizontally when looking at FIG. 23*d*, ensuring that the release mechanism reliably remains in the spreading position with the clamping pins 70 in the release position.

For mounting a creasing plate, the clamping pins 62 are brought into their release position. Then, the creasing plate is mounted at the creasing cylinder 21 such that the clamping pins engage into holes provided close to the edges of the creasing plate which are arranged opposite each other. Then, the release mechanism is returned into the rest position such that the clamping pins 62, under the effect of springs 68, pull the creasing plate 24 tight against the outer circumference of the creasing cylinder.

The clamping pins 62 are in the form of hooks so there is a slight undercut into which the creasing plate engages. This ensures that the creasing plate is mechanically held "under" the clamping pins 62 and cannot disengage axially outwardly when being clamped to the ceasing cylinder.

FIGS. 24*a* and 24*b* show the same clamping mechanism 60 which is known from the creasing cylinder.

The elastic layer 28 has a reinforcement plate 80 which is provided with holes 82 into which the clamping pins 62 engage.

The invention claimed is:

1. A creasing machine comprising:

a creasing tool, a counter element cooperating with the creasing tool, a controller to receive data for a new creasing job, and a transportation system for advancing sheets through a creasing area between the creasing tool and the counter element, wherein the creasing tool has a creasing plate provided with at least one creasing projection, wherein the at least one creasing projection on the creasing plate is constituted by a plurality of small, plastically deformed areas which merge into each other so as to form the at least one creasing projection, and wherein the controller determines, based on the received data, (a) if a previously manufactured creasing plate is available in storage and (b), if not, that a new creasing plate is to be manufactured.

2. The creasing machine of claim 1, further comprising a punching module.

3. The creasing machine of claim 2, wherein the punching module is a turret punching machine or a coil punching machine.

4. The creasing machine of claim 2, wherein the punching module has a punch and a die, the punch having rounded end portions.

5. The creasing machine of claim 4, wherein the rounded end portions have at least one of a large and a small radius, wherein radii at the rounded end portions of the punch are in the order of 0.2 to 2 millimeters for the small radius and 2 to 15 millimeters for the large radius.

6. The creasing machine of claim 4, wherein the punch extends along a straight line and has a length, measured along the straight line, in the order of 5 mm to 50 mm.

7. The creasing machine of claim 4, wherein the die has a recess for receiving material plastically deformed by the punch, the recess having at least one laterally open end, the open end coinciding with one of the rounded end portions of the punch.

8. The creasing machine of claim 7, wherein the die has an outer contour which extends, adjacent the open end of the recess, at an angle of less than 90° with respect to a longitudinal direction of the recess.

9. The creasing machine of claim 8, wherein the outer contour extends at an angle of 45° with respect to the longitudinal direction of the recess.

10. The creasing machine of claim 4, wherein an elastic ejector is associated with the die.

11. The creasing machine of claim 2, wherein a handling system is provided for transferring the creasing plate from the punching module to the creasing tool.

12. The creasing machine of claim 11, wherein an inventory is associated with the handling system.

13. The creasing machine of claim 1, wherein the controller, based on the determination, initiates the manufacture of the new creasing plate or retrieval of the previously manufactured creasing plate for use as the creasing plate in the creasing tool.

14. The creasing machine of claim 1, wherein the creasing plate has a thickness in the range of 0.2 to 0.6 mm.

15. The creasing machine of claim 1, wherein a radius at an apex of the creasing projection is in the order of 0.2 to 0.8 mm.

16. The creasing machine of claim 1, wherein the creasing tool is a creasing cylinder to which the creasing plate is mounted.

17. The creasing machine of claim 16, wherein the creasing plate is a curved plate which is clamped to the creasing cylinder.

18. The creasing machine of claim 16, wherein the creasing plate is a creasing sleeve which is clamped onto the creasing cylinder.

19. The creasing machine of claim 16, further comprising clamping pins extending into openings of the creasing plate.

20. The creasing machine of claim 19, wherein a cam mechanism is provided for moving the clamping pins between a clamping position and a release position.

21. The creasing machine of claim 16, wherein a driving fillet is provided on the creasing plate, extending along the majority of the circumference of the creasing cylinder.

22. The creasing machine of claim 21, wherein the driving fillet is added onto the creasing plate and includes an epoxy material.

23. The creasing machine of claim 1, wherein the counter element is covered by a layer made from a shape memory material.

24. The creasing plate adapted for being used in the creasing machine according to claim 1, the creasing plate being made from sheet metal and comprising the at least one creasing projection formed from a plurality of small, plastically deformed areas which merge into each other so as to form the at least one creasing projection.

25. A method for creasing a sheet, the method comprising:

receiving data regarding folding creases to be applied to the sheet, determining (a) if a suitable creasing plate is available in an inventory and (b), if not, that a new creasing plate is to be manufactured, retrieving, based on the determining, an existing creasing plate from the inventory or manufacturing a new creasing plate by using a punching module for applying a plurality of small deformations to a creasing plate sheet, the deformations constituting at least one creasing projection, mounting the creasing plate on a creasing tool, and applying folding creases to the sheet advanced through a creasing area between the creasing tool and a counter element.

* * * * *